US007512364B2

(12) United States Patent
Muramatsu et al.

(10) Patent No.: US 7,512,364 B2
(45) Date of Patent: Mar. 31, 2009

(54) IMAGE FORMING APPARATUS INCLUDING A DEVELOPER REPLENISHING DEVICE FOR A TWO-INGREDIENT TYPE DEVELOPER

(75) Inventors: Satoshi Muramatsu, Tokyo (JP); Nobuo Iwata, Kanagawa (JP); Nobutaka Takeuchi, Kanagawa (JP); Junichi Matsumoto, Kanagawa (JP); Takayuki Koike, Kanagawa (JP); Eriko Maruyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/519,046

(22) Filed: Sep. 12, 2006

(65) Prior Publication Data

US 2007/0009289 A1 Jan. 11, 2007

Related U.S. Application Data

(63) Continuation of application No. 11/018,668, filed on Dec. 22, 2004, now Pat. No. 7,127,198.

(30) Foreign Application Priority Data

Dec. 26, 2003 (JP) ..... 2003-435539

(51) Int. Cl.
*G03G 15/08* (2006.01)

(52) U.S. Cl. ..... 399/258

(58) Field of Classification Search ..... 399/258, 399/57, 237, 257, 260, 262
See application file for complete search history.

(56) References Cited

U.S. PATENT DOCUMENTS 4,133,458 A * 1/1979 Budny ..... 222/228
4,347,299 A * 8/1982 Ozawa et al. ..... 430/122.8
5,815,784 A 9/1998 Kasahara et al.
5,953,567 A 9/1999 Muramatsu et al.
5,960,246 A 9/1999 Kasahara et al.
5,987,298 A 11/1999 Muramatsu et al.
6,112,046 A 8/2000 Suzuki et al.
6,628,915 B2 9/2003 Muramatsu et al.

(Continued)

FOREIGN PATENT DOCUMENTS

JP 57006872 A * 1/1982

(Continued)

OTHER PUBLICATIONS

U.S. Appl. No. 11/932,198, filed Oct. 31, 2007, Takeuchi, et al.

(Continued)

*Primary Examiner*—Quana M Grainger
(74) *Attorney, Agent, or Firm*—Oblon, Spivak, McClelland, Maier & Neustadt, P.C.

(57) ABSTRACT

An image forming apparatus of the present invention includes a developing unit for developing a latent image formed on an image carrier with a two-ingredient type developer, i.e., a toner and carrier mixture. A toner replenishing device replenishes toner stored in a toner storing portion to the developing unit. A carrier storing portion, storing a carrier therein, is constructed independently of the toner storing portion. The carrier is fed from the carrier storing portion to the developing unit by a toner conveying force available with the toner replenishing device.

8 Claims, 17 Drawing Sheets

U.S. PATENT DOCUMENTS

| | | | | |
|---|---|---|---|---|
| 6,776,099 | B1 * | 8/2004 | Landa et al. | 101/489 |
| 6,785,496 | B2 | 8/2004 | Iwata et al. | |
| 6,826,381 | B2 * | 11/2004 | Muramatsu et al. | 399/260 |
| 7,062,206 | B2 * | 6/2006 | Fujii et al. | 399/258 |
| 2003/0235436 | A1 * | 12/2003 | Kasahara et al. | 399/258 |
| 2004/0228660 | A1 * | 11/2004 | Iikura et al. | 399/260 |
| 2007/0009289 | A1 | 1/2007 | Muramatsu et al. | |

FOREIGN PATENT DOCUMENTS

| | | | |
|---|---|---|---|
| JP | 57171346 | A * | 10/1982 |
| JP | 06-301289 | | 10/1994 |
| JP | 07-104569 | | 4/1995 |
| JP | 07234575 | A | 9/1995 |
| JP | 11-212346 | | 8/1999 |
| JP | 2001-183893 | | 7/2001 |
| JP | 2001-194908 | | 7/2001 |
| JP | 2001-209244 | | 8/2001 |
| JP | 2003-195617 | | 7/2003 |
| JP | 2003-195618 | | 7/2003 |
| JP | 2003-223043 | | 8/2003 |

OTHER PUBLICATIONS

U.S. Appl. No. 11/931,025, filed Oct. 31, 2007, Muramatsu.
U.S. Appl. No. 12/126,441, filed May 23, 2008, Matsumoto, et al.
U.S. Appl. No. 12/129,961, filed May 30, 2008, Katoh, et al.
U.S. Appl. No. 12/130,092, filed May 30, 2008, Ohmura, et al.
U.S. Appl. No. 12/178,986, filed Jul. 24, 2008, Matsumoto, et al.

* cited by examiner

IMAGE FORMING APPARATUS

IMAGE FORMING APPARATUS INCLUDING A DEVELOPER REPLENISHING DEVICE FOR A TWO-INGREDIENT TYPE DEVELOPER

BACKGROUND OF THE INVENTION

1. Field of the Invention

The present invention relates to an image forming apparatus including a developing unit using a two-ingredient type developer, i.e., a toner and carrier mixture and more particularly to a developer replenishing device for replenishing the developer to the developing unit.

2. Description of the Related Art

A printer, copier, facsimile apparatus, multifunction machine or similar image forming apparatus of the type using a developing unit that develops a latent image with a two-ingredient type developer or toner and carrier mixture is conventional. It is a common practice with this type of image forming apparatus to replenish fresh toner from a toner cartridge or similar toner container and replace, when the toner cartridge runs out of toner, the toner container with a new toner container.

Although the carrier is not consumed by image formation, it is deteriorated in ability due to repeated image formation and must therefore be replaced every time image formation is repeated a certain number of times. Generally, a service person replaces the carrier in the case of a copier or bodily replaces, in the case of a printer, the entire developing unit in which the carrier is present.

On the other hand, Japanese Patent Laid-Open Publication No. 11-212346, for example, proposes to replenish a fresh carrier from a carrier container to a developing unit little by little. Also, Japanese Patent Laid-Open Publication No. 2001-209244 teaches a system in which a fresh carrier is caused to join fresh toner being replenished while excess carrier is discharged from a developing unit little by little. This system, according to the above document, obviates the deterioration of a developer for thereby implementing stable image quality over a long period of time without resorting to periodic carrier replacement.

However, many of conventional carrier replenishing devices, including the schemes described above, use a screw for conveying the carrier, so that a carrier conveying path must be arranged substantially straight, i.e., cannot be extended upward. This limitation, combined with other limitations ascribable to the screw, causes the carrier storing portion of the carrier replenishing device to be necessarily positioned in the vicinity of a developing unit. Such a position is undesirable because a toner and a carrier replenishing device cannot be located at a position where they can be easily replaced by the user of the apparatus and because size reduction of the apparatus is obstructed. Moreover, in the case where the carrier is replenished independently of the toner, an exclusive space must be allocated to the carrier replenishing device, increasing the overall size of the apparatus. This is particularly true in a color image forming apparatus needing a plurality of developer replenishing devices.

In light of the above, there has been proposed a developer replenishing device of the type using a powder pump for conveying a developer. This type of developer replenishing device conveys a toner and carrier mixture via a hollow tube with the pressure of the powder pump and compressed air that fluidizes the mixture, thereby implementing noticeably free layout of a conveying path. This, in turn, promotes the free layout of a toner and a carrier storing section and that of a developing unit for thereby facilitating the replacement of a toner and a carrier cartridge and implementing size reduction of the apparatus. However, this type of developer replenishing device is not simple in construction and occupies a large exclusive space in the case of a color image forming apparatus needing a plurality of developer replenishing devices, increasing the overall size of the apparatus.

SUMMARY OF THE INVENTION

It is an object of the present invention to provide a developer replenishing device simple in construction even when configured to convey toner and a carrier with an air stream or a powder pump and capable of controlling carrier replenishment independently of toner replenishment, and an image forming apparatus including the same.

An image forming apparatus of the present invention includes a developing unit configured to develop a latent image formed on an image carrier with a two-ingredient type developer or tone and carrier mixture. A toner replenishing device replenishes fresh toner stored in a toner storing portion to the developing unit. A carrier storing portion stores a fresh carrier and is constructed independently of the toner storing portion. The fresh carrier is fed from the carrier storing portion to the developing unit by a toner conveying force available with the toner replenishing device.

An image forming apparatus of the present invention includes a developing unit configured to develop a latent image formed on an image carrier with a two-ingredient developer made up of a toner and a carrier. A toner replenishing device replenishes a toner stored in a toner storing portion to the developing unit. A carrier replenishing device replenishes a carrier stored in a carrier storing portion to the developing unit. The toner replenishing device includes a single axis, eccentric screw pump using a discharge pressure and an air feeding device for feeding compressed air to a position adjoining an outlet of the screw pump to thereby fluidize the toner. The carrier replenishing device is connected to a suction port of the air feeding device and an air and carrier mixture is fed to the outlet of the screw pump.

An image forming apparatus of the present invention includes a developing unit configured to develop a latent image formed on an image carrier with a two-ingredient developer made up of a toner and a carrier. A toner replenishing device replenishes a toner stored in a toner storing portion to the developing unit. A carrier replenishing device replenishes a carrier stored in a carrier storing portion to the developing unit. The toner replenishing device includes a single axis, eccentric screw pump using a discharge pressure and an air feeding device for feeding compressed air to an inside of the toner storing portion and a position adjoining an outlet of the screw pump to thereby fluidize the toner. The carrier replenishing device is connected to a suction port of the air feeding means and an air and carrier mixture is fed to the inside of the toner storing portion.

An image forming apparatus of the present invention includes a developing unit configured to develop a latent image formed on an image carrier with a two-ingredient developer made up of a toner and a carrier. A toner replenishing device replenishes a toner stored in a toner storing portion to the developing unit. A carrier replenishing device replenishes a carrier stored in a carrier storing portion to the developing unit. A toner replenishing device includes a single axis, eccentric screw pump using a suction pressure and an air feeding device for feeding compressed air to an inside of the toner storing portion and an outlet of said screw pump to thereby fluidize the toner. The carrier replenishing device is connected to a suction port of the air feeding device and an air and carrier mixture is fed to the inside of the toner storing portion.

An image forming apparatus of the present invention includes a developing unit configured to develop a latent image formed on an image carrier with a two-ingredient developer made up of a toner and a carrier. A toner replenishing device replenishes a toner stored in a toner storing portion to the developing unit. A carrier replenishing device replenishes a carrier stored in a carrier storing portion to the developing unit. The toner replenishing devices comprises an air feeding device for feeding compressed air to an inside a toner cartridge while the carrier replenishing device is connected to a suction port of aid air feeding means and an air and carrier mixture is fed to the inside of the toner cartridge.

BRIEF DESCRIPTION OF THE DRAWINGS

The above and other objects, features and advantages of the present invention will become more apparent from the following detailed description taken with the accompanying drawings in which.

DETAILED DESCRIPTION OF THE PREFERRED EMBODIMENTS

Figure 1:
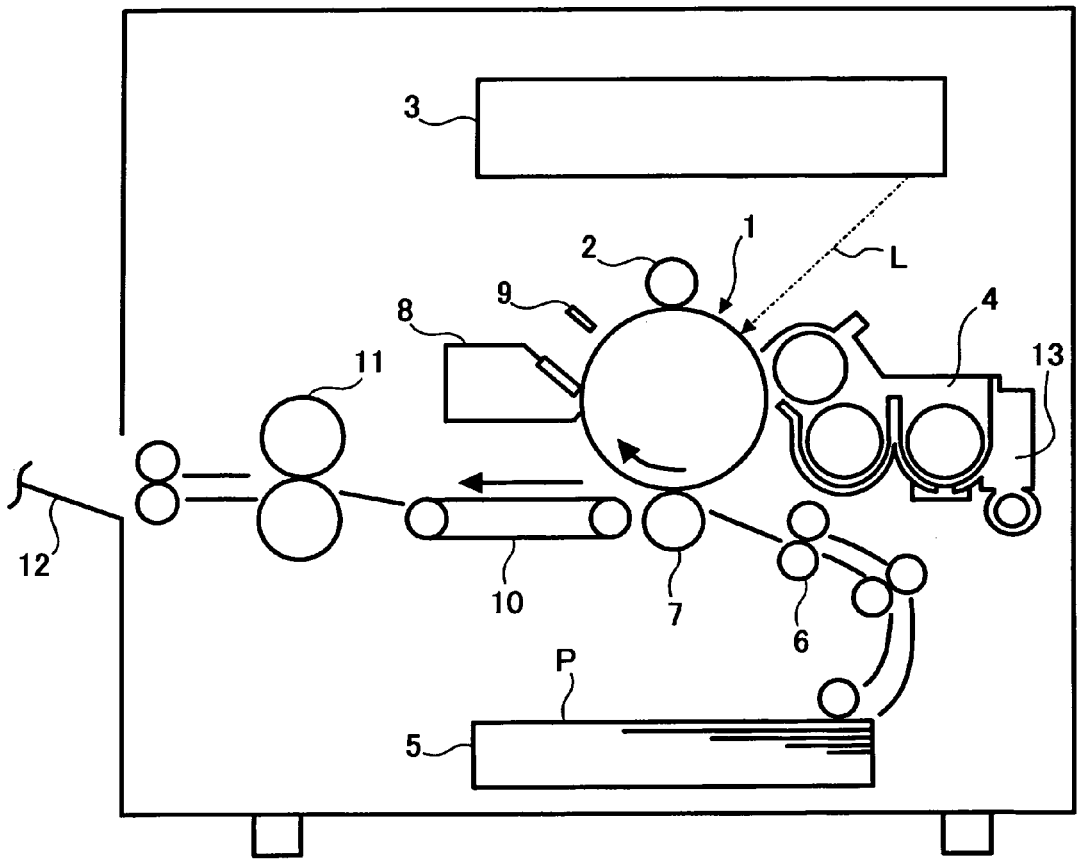
FIG. 1 is a view showing the general construction of an image forming apparatus in accordance with the present invention.

Referring to FIG. 1 of the drawings, an image forming apparatus in accordance with the present invention is shown and implemented as a laser printer by way of example. As shown, the laser printer includes a photoconductive drum 1, which is a specific form of a photoconductive element or image carrier. While the photoconductive drum (simply drum hereinafter) 1 is rotated clockwise, as viewed in FIG. 1, a charge roller 2 uniformly charges the surface of the drum 1 to preselected polarity. A laser writing unit 3 scans the charged surface of the drum 1 with a laser beam L modulated in accordance with image data, thereby forming a latent image on the drum 1. A developing unit 4 develops the latent image with toner for thereby producing a corresponding toner image.

A sheet feeding device 5 is arranged in the lower portion of the printer and loaded with a stack of paper sheets or similar recording media P. A paper sheet P is fed from the sheet feeding device 5 to a nip between the drum 1 and an image transfer roller 7 via a registration roller pair 6. A voltage, opposite in polarity to toner deposited on the drum 1, is applied to the image transfer roller 7 to thereby transfer the toner image from the drum 1 to the paper sheet P. Toner left on the drum 1 after the image transfer is removed by a cleaning unit 8. Thereafter, a discharger 9 discharges the surface of the drum 1 in order to prepare the drum 1 for the next image forming cycle.

The paper sheet P, carrying the toner image thereon, is conveyed to a fixing device 11 by a belt 10, so that the toner image is fixed by the fixing device 11. Subsequently, the paper sheet or print P is driven out to a print tray 12 by an outlet roller pair.

Figure 2:
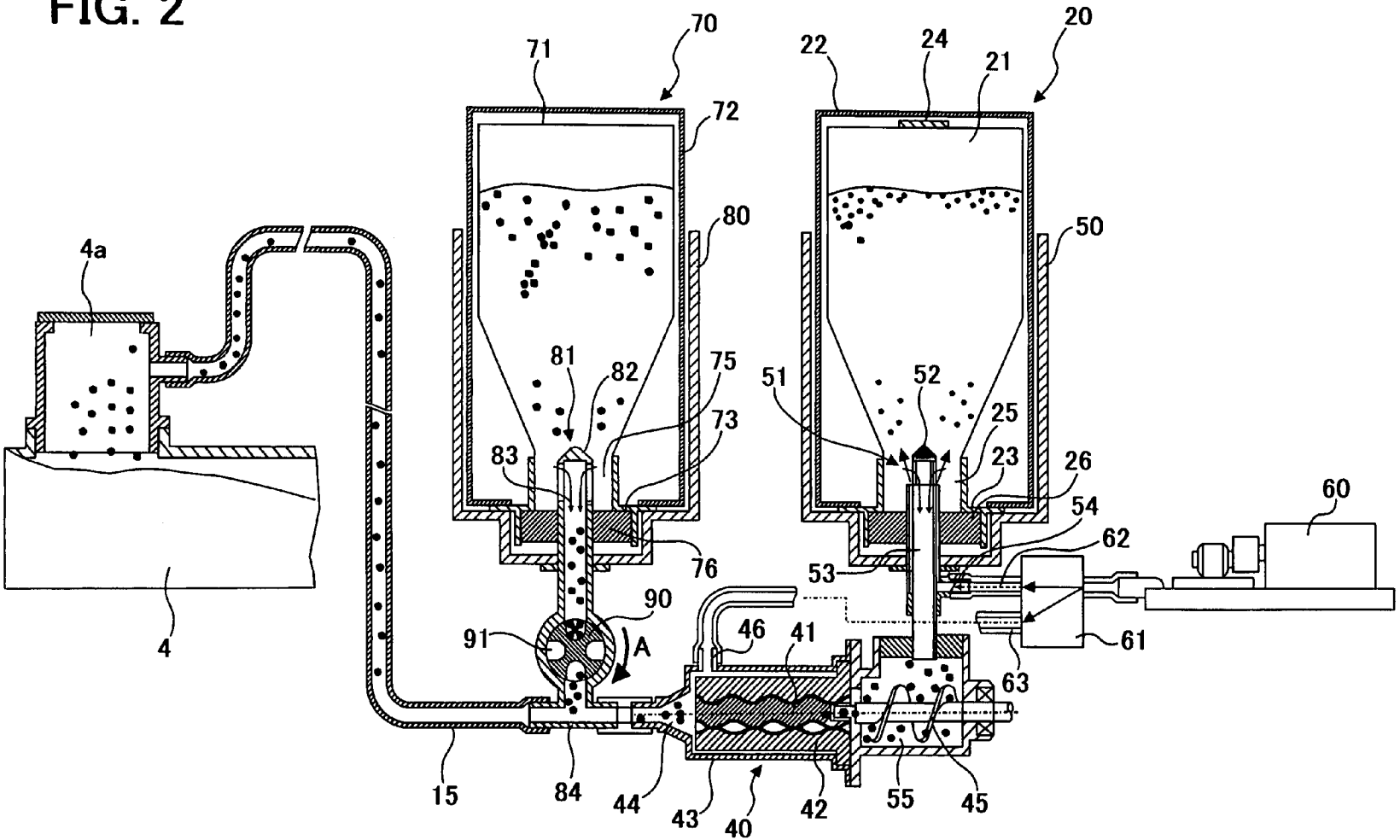
FIG. 2 is a section showing a developer replenishing device embodying the present invention.

In the illustrative embodiment, the developing unit 4 uses a two-ingredient type developer, i.e., a toner and carrier mixture. A toner or developer replenishing device is included in the developing unit 4 for making up for the consumption of toner ascribable to repeated development. FIG. 2 shows a preferred embodiment of the toner or developer replenishing device in accordance with the present invention. As shown, the toner replenishing device includes a toner container 20 made up of a toner bag 21 storing toner, a case 22 surrounding the toner bag 21 for protecting it, and a mouth member 23 affixed to the bottom of the toner bag 21.

The toner bag 21 is provided with a hermetically sealed structure that does not allow air to flow into or out of the toner bag 21. To form such a toner bag 21, one or more sheets formed of polyethylene, nylon or similar resin or paper and about 50 πm to 250 πm thick each may be folded or four sheets may be deposited, adhered or otherwise connected together. A filter 24 is positioned on the top of the toner bag 21 for preventing pressure inside the toner bag 21 from rising to an excessive degree. The case 22 is formed of paper, corrugated cardboard, plastic or similar rigid material and is partly engaged with the mouth member 23.

The mouth member 23 is formed with a toner outlet 25. A seal member 26 is fitted in the lower portion of the toner outlet 25 and formed with a slit, not shown, in which a nozzle to be described later specifically is capable of being inserted. The toner outlet 25 with this configuration is usually closed by a seal member 26. The mouth member 25 is formed of polyethylene, nylon or similar resin. The toner bag 21 and mouth member 23 may be formed of the same material in order to promote efficient recycling and facilitate deposition of the toner bag 21 on the mouth member 23.

In the toner container 20, the toner bag 21 should preferably be reduced in size toward the mouth member 23 positioned at the bottom of the toner bag 21, so that fresh toner stored in the toner bag 21 can easily move toward the mouth member 23. This successfully reduces the amount of fresh toner to be left in the bag 21 without being replenished. The position of the toner bag 21 where the size begins to be reduced is open to choice so long as the walls of the toner bag 21 can be provided with some inclination toward the mouth member 23.

The toner container 20 is removably set on a mount portion arranged at a suitable position inside of the apparatus body. The mount portion includes a holder 50 formed of resin and configured to receive and support the toner container 20. A nozzle 51 stands upright on the bottom of the holder 50 such that it penetrates into the toner container 20 when the toner container 20 is mounted to the holder 50. The nozzle 51 has a pointed tip 52 that allows the nozzle 51 to smoothly penetrate the seal member 26. The nozzle 51 is provided with a double tube structure forming a toner passage 53 and an air passage 54 at the inside and outside, respectively, and is fluidly communicated to the upper part of a toner storing portion 55. In this configuration, fresh toner present in the toner bag 21 drops to the toner storing portion 55 via the nozzle 51 and is stored in the toner storing portion 55. The air passage 54 is bent sideways and fluidly communicated to air feeding means by an air feed tube, as will be described more specifically later.

The toner storing portion 55 mentioned above is disposed in a powder pump unit and adjoins a powder pump 40, which plays the role of toner replenishing means. The powder pump 40 is made up of a female-screw type stator 42 made of rubber or similar elastic material and formed with a double-pitch spiral groove and a male-screw type rotor 41 rotatably received in the stator 42 and made of metal, resin or similar rigid material. The rotor 41 is connected to the shaft of a screw 45 by, e.g., a spring pin and caused to rotate when the screw 45 is rotated. This powder pump 40 is sometimes referred to as a single axis, eccentric screw pump because the movement of the rotor 41 is eccentric. A plurality of spaces are formed between the rotor 41 and the stator 42 and move in accordance with the rotation of the rotor 41 while remaining in their original configuration. Therefore, the amount of conveyance available with the powder pump 40 can be highly accurately controlled on the basis of the amount of rotation of the rotor 41. The powder pump 40 further includes a holder 43 formed of resin and surrounding the stator 42. The holder 43 is formed with a toner outlet 44 and an air inlet 46 to which air is fed from an air pump to be described specifically later.

The toner outlet 44 of the powder pump 40 is fluidicly communicated to a developer inlet 4*a* formed in the developing unit 4 by a tube 15 having an inside diameter of about 3 mm to 7 mm. The tube 15 should preferably be formed of polyurethane rubber, nitrile rubber, EPDM (ethylene propylene rubber) or similar flexible, highly toner-resistant rubber or polyethylene, nylon or similar plastic, so that it can be freely laid out and promote the free layout of the entire printer.

Further, even if the toner container 20 is positioned at a lower level or height than the developing unit 4, the toner replenishing device can surely convey toner because it uses the pressure of the powder pump 40. The toner container 20 can therefore be located at any desired position, e.g., a position where the toner can be most easily replaced.

To smoothly convey toner whose fluidity is low, the toner conveying device fluidizes toner with air, as will be described hereinafter. Air under pressure is fed from an air pump 60 to the toner present in the toner bag 21 via a solenoid-operated two-way valve 61, the tube 62 and the nozzle 51. Air thus sent into the toner bag 21 prevents, after toner around the nozzle 51 has been sucked by the powder pump 40, a void from being formed around the nozzle 51 (so-called toner bridging) and making the amount of replenishment unstable and prevents toner from being left in the toner bag 21 in an extremely great amount. More specifically, air which has entered the toner bag 21 fluidizes toner by agitating it for thereby obviating toner bridging or breaking down bridging toner. This successfully stabilizes the amount of replenishment and reduces the amount of toner to be left in the toner bag 21. The filter 24, positioned at the top of the toner bag 21, passes only air therethrough to thereby prevent pressure inside the toner bag 21 from rising due to the entry of compressed air.

The air pump 60 is fluidly communicated to the air inlet 46 of the powder pump 40 by the solenoid-operated two-way valve and a tube 63 as well. The two-way valve 61 is configured such that when compressed air should be fed to one of the toner bag 21 and air pump 40, the air passage to the other is blocked. Because air must be fed to the powder pump 40 in the event of toner replenishment, the feed of air to the toner bag 21 is effected before or after toner replenishment or may be effected periodically without regard to toner replenishment so long as it does not overlap toner replenishment.

While fresh toner, forming part of the two-ingredient type developer, is replenished to the developing unit 4 by the toner replenishing device described above, a fresh carrier, forming the other part of the developer, basically does not have to be replenished because it is not consumed by development. However, the carrier is deteriorated in terms of its ability due to aging little by little and such degrades image quality in due course. Although a carrier has customarily been replaced by a service person at adequate timing estimated on the basis of, e.g., the number of images formed in the past, such replacement is not easy to perform.

In light of the above-noted discussion, in the illustrative embodiment, a carrier is also replenished little by little so as to insure stable image quality over a long period of time without being replaced, as will be described hereinafter. As shown in FIG. 2, a carrier container or carrier storing portion 70 is formed of the same material and provided with the same configuration as the toner container 20 described above. More specifically, the carrier container 70 is made up of a carrier bag 71, a case 72 for protection and a mouth member 73 formed with a carrier outlet 75. A seal member 76 is fitted in the lower portion of the carrier outlet 75 and formed with a slit, not shown, that allows a nozzle to be described later to be inserted into the seal member 76. The carrier container 70 differs from the toner container 20 in that the filter 24 is absent because the carrier has sufficient fluidity to make the feed of compressed air to the carrier bag 32 unnecessary.

The carrier container 70 is removably set on a mount portion positioned above the tube or toner replenishing path 15. The mount portion includes a holder 80 formed of resin and configured to receive and support the carrier container 70. A nozzle 81 stands upright on the bottom of the holder 80 such that it penetrates into the carrier container 70 when the carrier container 70 is mounted to the holder 80. The nozzle 81 has a pointed tip 82 that allows the nozzle 81 to smoothly penetrate the seal member 76. A carrier passage 83 is formed in the nozzle 81 and joins the toner replenishing path via a joint member 84.

A roller or replenishing member 90 is disposed in the carrier passage 83 in order to prevent the toner from entering the carrier container 70 and to replenish the carrier by a preselected amount. The roller 90 has a diameter large enough to fully block the carrier passage 83 and is caused to rotate by drive means, not shown, in a direction indicated by an arrow A in FIG. 2. A plurality of metering cavities 91 are formed in the circumferential surface of the roller 90 for receiving a preselected amount of carrier each. The portion of the carrier passage 83 accommodating the roller 90 is formed with a bulge in which the roller 90 is fitted. While the roller 90 is shown as being formed with four cavities 91 at an angular distance of 90°, the number of the cavities 91 is open to choice. In the illustrative embodiment, the joint member 84, implemented as a generally T-shaped tubular member, is formed integrally with the nozzle 81.

The carrier is implemented as carrier grains each having a grain size of about 20 πm to 200 πm and consisting of iron powder, ferrite powder, magnetize powder, magnetic resin or similar conventional core and a coating layer of amino resin, polyvinyl or polyvinylidene resin, polystyrene resin, silicon resin or similar resin covering the core. As for the toner, use may be made of toner grains formed by mixing binder resin, a wax component, a colorant and, if necessary, a charge control agent with, e.g., a mixer, kneading the resulting mixture with a heat roll, extruder or similar kneader, cooling the mixture thus kneaded to thereby solidify it, pulverizing the solid mixture with, e.g., a jet mill and then classifying the resulting grains, toner grains formed by polymerization or similar grains. The toner grains have a grain size of about 4 πm to 10 πm each.

Operation of the illustrative embodiment will be described hereinafter. When the air pump 60 operated, it delivers compressed air, or an air stream, to the fresh toner stored in the toner container 20 for thereby fluidizing the toner. As a result, the toner easily drops into the toner storing portion 55, which adjoins the powder pump 40, and is stored therein for a moment. Subsequently, the screw 45, arranged in the toner storing portion 55, is caused to turn for conveying the toner into the powder pump 40. The powder pump 40 causes the toner to gush out via the outlet 44 with its discharge pressure. At this instant, compressed air is fed from the air pump 60 into the toner gushed out from the powder pump 40 via the solenoid-operated two-way valve 61, tube 63 and air inlet 46, fluidizing the toner. The toner thus fluidized is easily conveyed to the developer inlet 4*a* of the developing unit 4 via the tube 15 by the discharge pressure of the powder pump 40.

When the toner container 20 and carrier container 70 are respectively mounted to the holders 50 and 80 and moved downward, the nozzles 51 and 81 respectively penetrate into the mouth members 23 and 73 of the toner container 20 and carrier container 70. As a result, the carrier, stored in the carrier container 70 and far higher in fluidity than the toner, drops into the carrier passage 83 of the nozzle 81 due to gravity and enters one of the metering cavities 91 formed in the roller 90. The roller 90 is rotated to convey the carrier thus metered by the above cavity 91 to the tube 15. Subsequently, the carrier joins the toner brought into the tube 15 and is then conveyed to the developing unit 4 together with the toner, i.e., by using the conveying force available with the powder pump 40. In this sense, the toner replenishing device serves as a developer replenishing device.

In the illustrative embodiment, the amount of rotation of the roller 91 is controllable in order to control the amount of fresh carrier to be replenished in accordance with the deterioration of the carrier present in the developing unit 4. It is noteworthy that because the roller 90 constantly isolates the carrier storing section from the toner replenishing path, the toner is surely prevented from being introduced into the carrier container 70 due to the discharge pressure of the powder pump 40 even when, e.g., the fresh toner in the carrier container 70 becomes short. Because the carrier is replenished on the basis of gravity, the carrier container 70 should preferably be positioned right above the toner replenishing path.

As stated above, the illustrative embodiment replenishes the fresh carrier to the developing unit 4 by using the toner conveying force available with the toner replenishing device and therefore accomplishes this task with a simple configuration. In addition, the illustrative embodiment can replenish the necessary amount of carrier at the necessary time without fail for thereby preventing an excessive amount of carrier from existing in the developing unit 4. It is to be noted that the fresh carrier thus replenished into the developing unit 4 increases the total amount of developer present in the developing unit 4, so that a mechanism for discharging excessive part of the carrier from the developing unit 4 and storing it is required. Such a mechanism can be easily implemented by any conventional scheme, e.g., an overflow scheme. For example, as shown in FIG. 1, the developing unit 4 may be provided with a waste carrier tank 13 configured to receive the developer overflowed sideways in accordance with the developer level.

Figure 3:
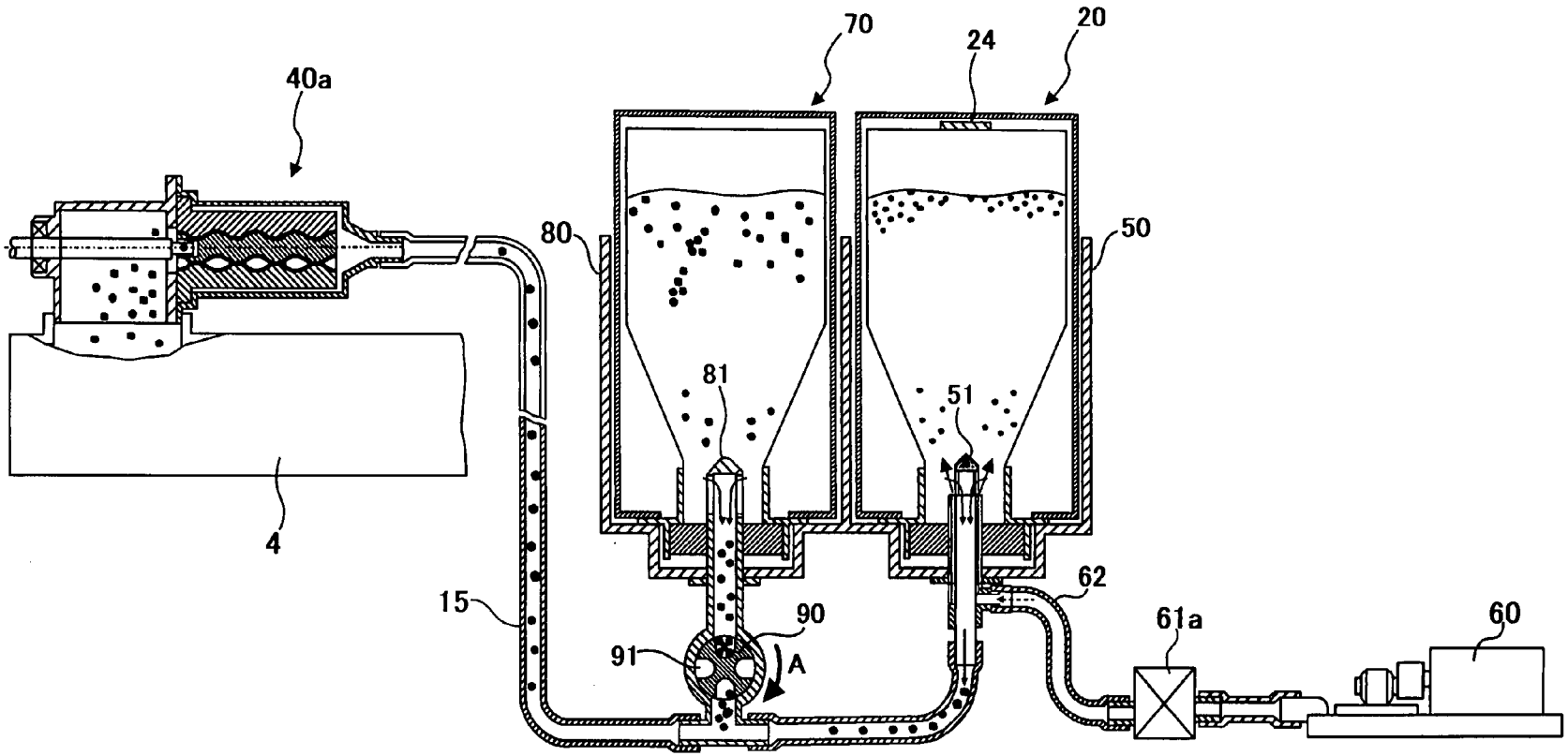
FIG. 3 is a section showing an alternative embodiment of the present invention.

Reference will be made to FIG. 3 for describing an alternative embodiment of the developer replenishing device in accordance with the present invention. The illustrative embodiment differs from the previous embodiment in that the powder pump 40*a* is implemented as a suction type single axis, eccentric screw pump associated with the developing unit 4. As for the toner container 20, carrier container 70 and nozzles 51 and 81, the illustrative embodiment is identical with the previous embodiment. In FIG. 3, structural parts and elements identical with those shown in FIG. 2 are designated by identical reference numerals, and a detailed description thereof will not be made in order to avoid redundancy.

In the illustrative embodiment, the air pump 60 feeds compressed air only into the toner container 20, so that a solenoid-operated valve 61*a* is substituted for the solenoid-operated two-way valve 61.

In operation, when the powder pump 40*a* is operated, it sucks the toner out of the toner container 20. At this instant, if the powder pump 40*a* sucks air from the air pump 60, then the amount of toner to be conveyed is reduced. In light of this, the solenoid-operated valve 61*a* is closed to block the air feed passage. Further, when use is made of the suction type powder pump 40*a*, a desirable sucking force is not achievable unless the toner replenishing path is a closed space. In this respect, while the illustrative embodiment also replenishes the carrier via the toner replenishing path, the roller 90 constantly isolates the toner replenishing path from the carrier storing portion, allowing the carrier to be successfully replenished to the developing unit 4.

As stated above, the illustrative embodiment also replenishes the fresh carrier to the developing unit 4 by using the toner conveying force available with the toner replenishing device and therefore with a simple configuration. In addition, the illustrative embodiment can replenish a necessary amount of carrier at a necessary time for thereby preventing an excessive amount of carrier from existing in the developing unit 4.

Figure 4:
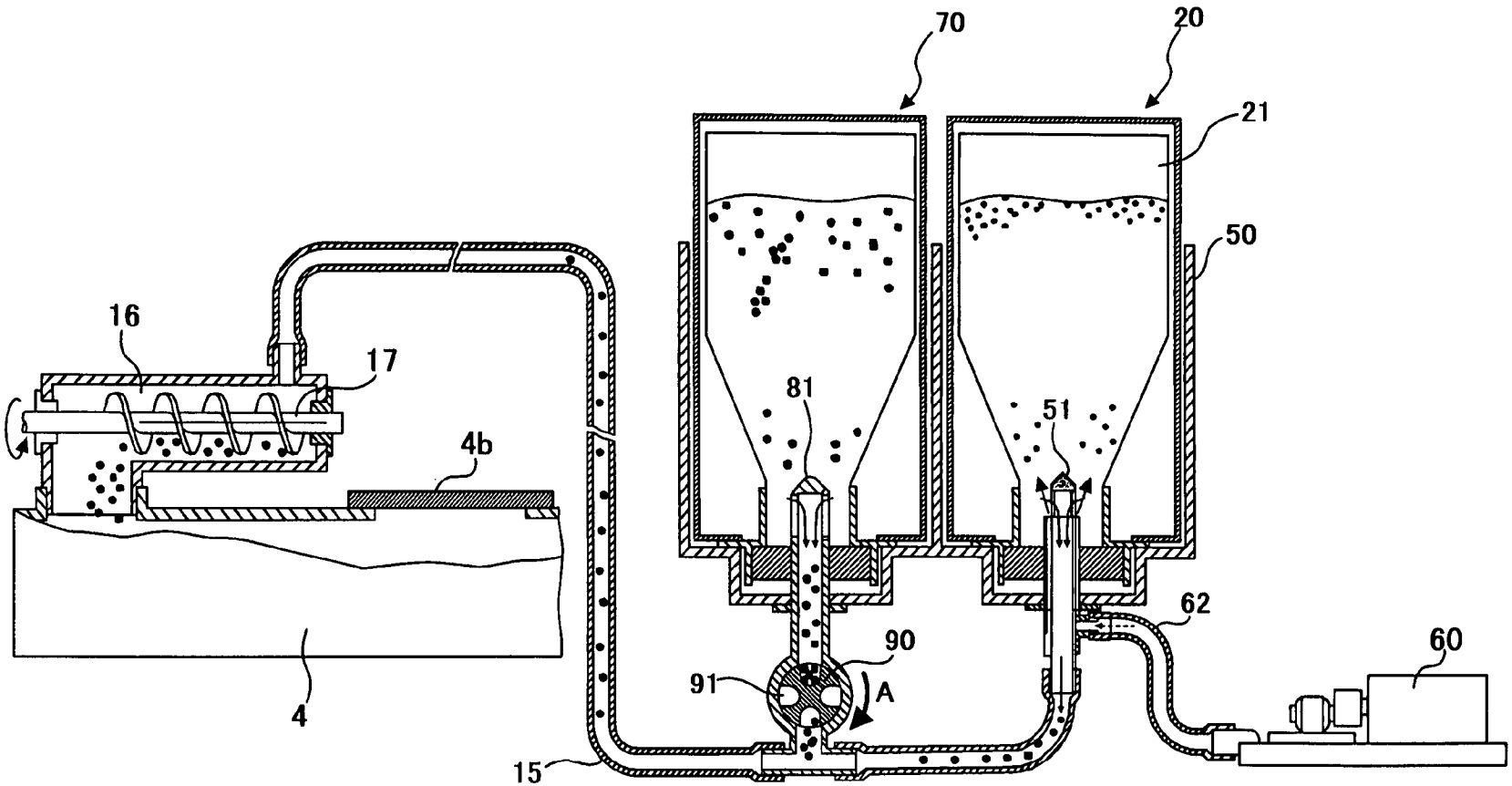
FIG. 4 is a section showing another alternative embodiment of the present invention.

FIG. 4 shows another alternative embodiment of the present invention. As shown, the illustrative embodiment differs from the embodiments shown in FIGS. 2 and 3 in that the toner conveying means for conveying toner and carrier is implemented by the air pressure fed from the air pump 60, and in that the filter 24 of the toner bag 21 is omitted to hermetically seal the toner bag 21. As for the rest of the construction, the illustrative embodiment is identical with the embodiments of FIGS. 2 and 3.

In the illustrative embodiment, compressed air fed from the air pump 60 to the toner container 20 via the nozzle 51 not only fluidizes the toner stored in the toner container 20, but also raises pressure inside of the toner container 20. As a result, pressure inside the toner container 20 tends to discharge air and toner to the outside of the toner container 20, so that the toner is sharply conveyed to a hopper 16 included in the developing unit 4 via the tube 15. The toner thus brought to the hopper 16 is conveyed into the developing unit 4 by the screw 17, which is in rotation, in an adequate amount. The hopper 16 is significant in that because toner conveyance using compressed air makes it difficult to delicately control the amount of conveyance, the toner would render the toner content of the developer in the developing unit 4 uneven or would cause it to vary if directly replenished into the developing unit 4, degrading image quality.

The carrier fed into the tube 15 by the roller 90 is conveyed to the developing unit 4 via the tube 15 together with the toner by air under pressure. Because a great amount of air is sent from the air pump 60 to the developing unit 4, the illustrative embodiment additionally includes a filter 4*b* located at a suitable position of the developing unit 4 for venting air therethrough.

Figure 5:
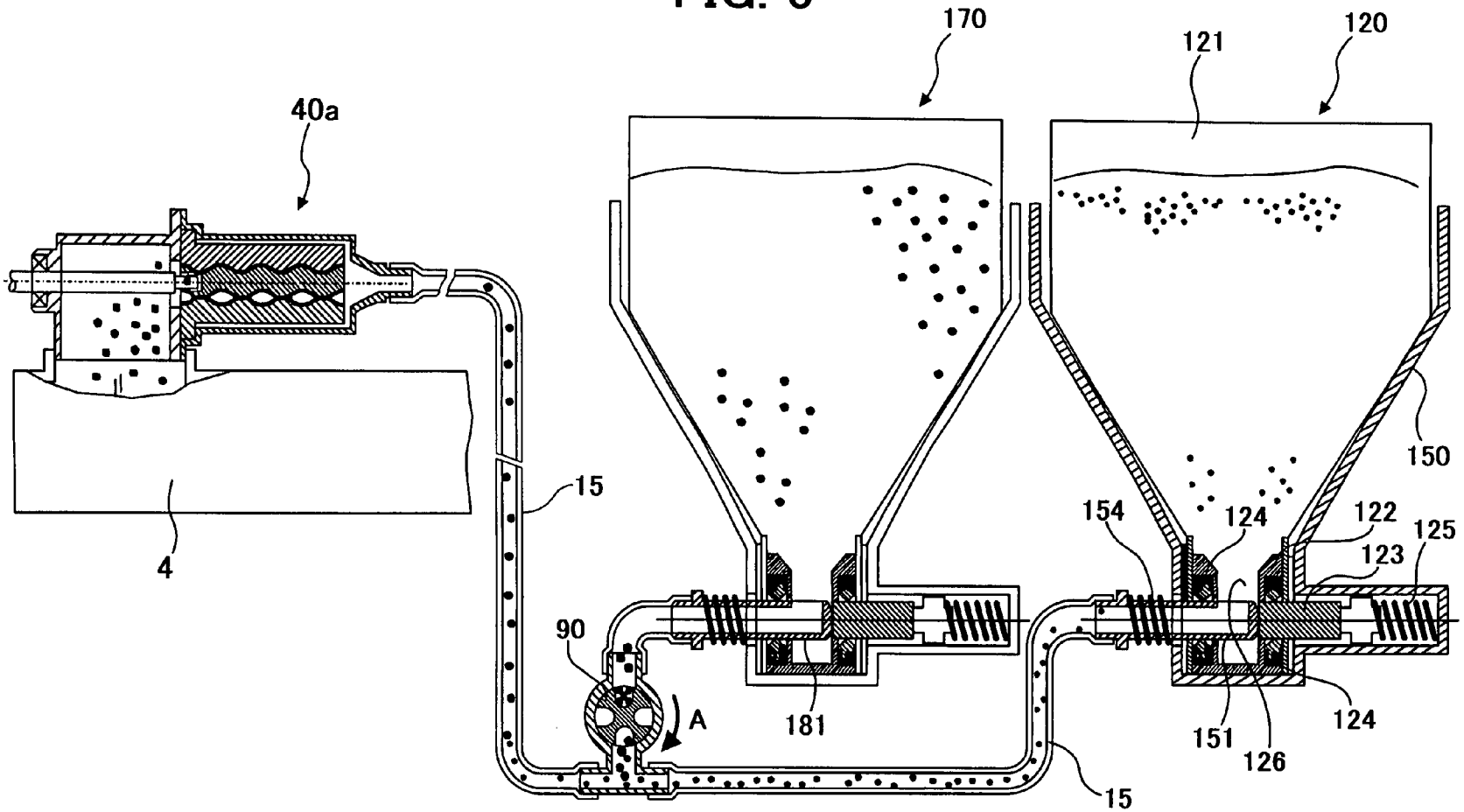
FIG. 5 is a section showing another alternative embodiment of the present invention.

FIG. 5 shows another alternative embodiment of the present invention. As shown, the illustrative embodiment resembles the embodiment of FIG. 3 except that compressed air is not fed to a toner container 120 and that the filter 24, FIG. 3, is absent on the toner container 120. In this configuration, the entire passage, extending from the toner container 120 to the suction type powder pump 40*a* via the toner conveying path, is substantially hermetically closed. Therefore, as the powder pump 40*a* sucks the toner out of the toner container 120, the volume of the toner container 120 automatically decreases by an amount corresponding to the amount of toner discharged from the toner container 120.

More specifically, the toner container 120 is made up of a bag-like soft, flexible toner storing member (referred to as a bag hereinafter) 121 and a mouth member 122 connected to the bottom of the bag 121. A nozzle 151 for suction is inserted into the mouth member 122. A shutter 123 prevents toner from flowing out of the bag 121 when the nozzle 151 is not inserted into the mouth member 151. Seal members 124 are positioned at both sides of the shutter 123 in order to implement hermetic sealing. The suction type powder pump 40*a* described with reference to FIG. 3 is fluidly communicated to the nozzle 151 by the tube 15.

The portion extending from the nozzle 151 to the developing unit 4 is affixed to the printer body. Every time the toner container 120 runs out of toner and is replaced with a new toner container, the nozzle 151 is released from the used container and then inserted into the new container. It is therefore extremely important to implement hermetic sealing between the mouth member 122 and the nozzle 151 for obviating smears and the leakage of air.

The toner container 121 is similar in configuration to the toner bag 21 included in the toner container 20. In the illustrative embodiment, after the toner container 120 has been mounted to the holder 150, the nozzle 151 is moved rightward, as viewed in FIG. 5, pushing the shutter 123 out of the mouth member 122. On the other hand, when the toner container 120 is removed from the holder 150, the nozzle 151 is moved leftward, as viewed in FIG. 5, with the result that the shutter 123 is elastically moved leftward by a spring 154 and a shutter return spring 125 and substantially entirely positioned in the mouth member 122 as in a fresh toner container, as illustrated. At this instant, the two seal members 124 closely contact each other to prevent a small amount of toner left in the toner container 120 from leaking to the outside. To move the nozzle 151 in the right-and-left direction, as stated above, use may be made of a manual lever, motor, solenoid or similar conventional moving means although not shown specifically. The seal members 124 are formed of, e.g., rubber capable of lightly contacting the shutter 123. The mouth member 122, made of resin or similar hard material, is formed with a toner outlet 126 and adhered or otherwise connected to the toner container 121.

A carrier container 170, storing carrier grains therein, and a nozzle 181 are identical in configuration with the toner container 120 and nozzle 151, respectively. In response to a carrier replenish signal, the roller 90 is rotated to cause the carrier grains to drop into the tube 15 in an amount corresponding to the amount of rotation of the roller 90. The carrier grains are then replenished to the developing unit 4 by the suction of the powder pump 40*a*.

The shutter type of sealing mechanism described above does not interfere with the toner flow passage. Further, the mouth member 122 does not have to be provided with an exclusive space for allowing the shutter 123 to retract outward of the mouth member 122 and is therefore extremely compact in configuration. In addition, because the above mechanism is arranged perpendicularly to the toner flow passage or pressure, the shutter 123 is prevented from being forced out when pressure inside the toner container 121 rises due to, e.g., atmospheric conditions.

Figure 6:
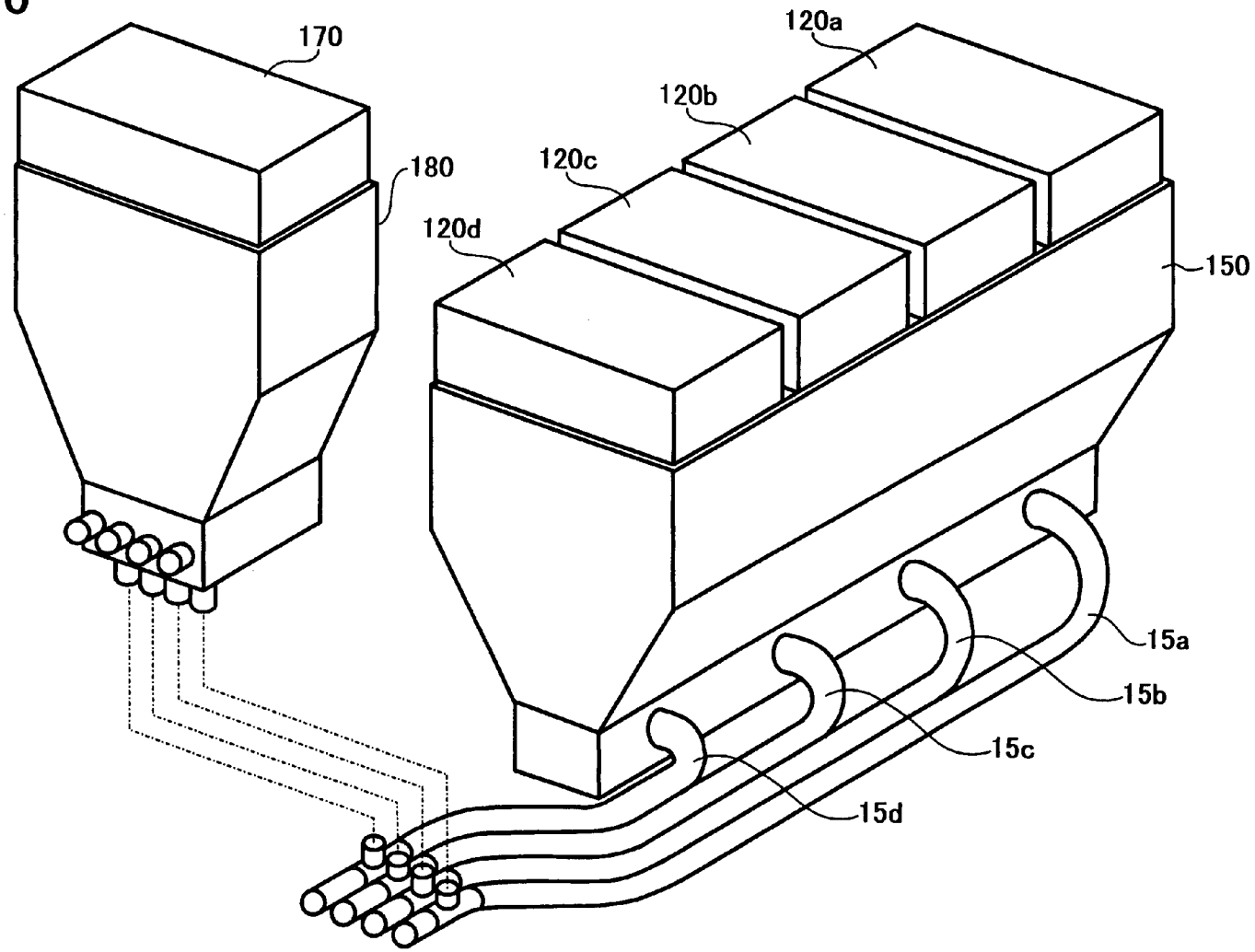
FIG. 6 is a perspective view showing another alternative embodiment of the present invention and applicable to a color image forming apparatus.

FIG. 6 shows another alternative embodiment of the present invention applied to a color laser printer. As shown, toner containers 120*a*, 120*b*, 120*c* and 120*d* storing yellow, magenta, cyan and black toners, respectively, by way of example are removably mounted to a holder 150. The toners are conveyed from the toner containers 120*a*, 120*b*, 120*c* and 120*d* to the developing unit, not shown, by the toner conveying means described with reference to any one of FIGS. 2 through 5 via tubes 15*a*, 15*b*, 15*c* and 15*d*, respectively.

A carrier container 170, storing a carrier therein, is removably mounted to a holder 180 and positioned in an array together with the toner containers 120*a* through 120*d*. The tubes 15*a* through 15*d*, assigned to the toner of a particular color each, all are arranged beneath the carrier container 170, so that the carrier metered by rollers to be described hereinafter can be easily replenished to the tubers 15*a* through 15*d* at the positions of joint members 184*a*, 184*b*, 184*c* and 184*d*, see FIG. 7.

Figure 7:
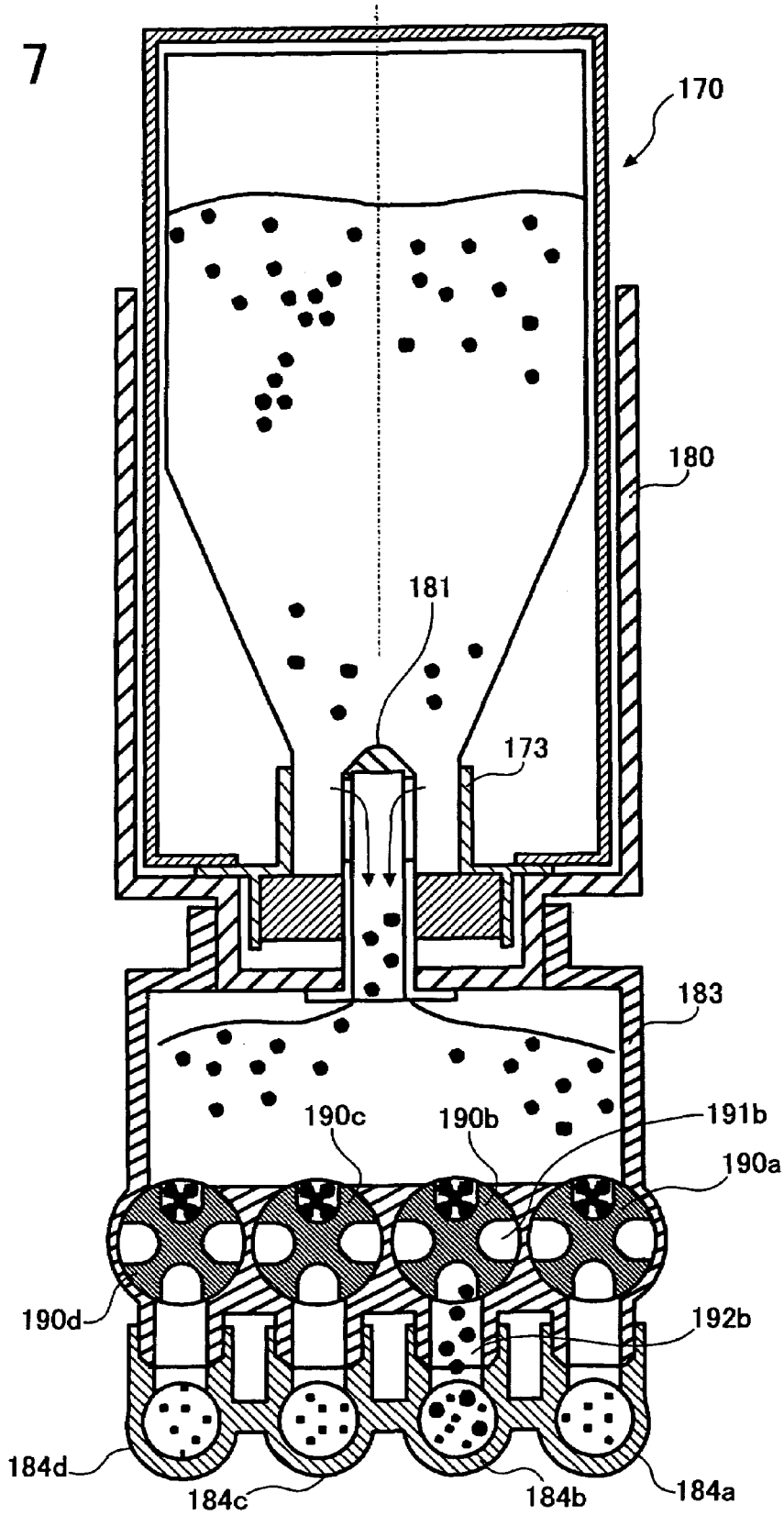
FIG. 7 is a section showing a carrier replenishing device included in the embodiment of FIG. 6.

As shown in FIG. 7, when the carrier container 170 is mounted to the holder 180, a nozzle 181 penetrates into a mouth member 173 included in the carrier container 170. As a result, the carrier, having far higher fluidity than the toner, drops into a carrier storing portion 183 via the nozzle 181 due to gravity and substantially fills up the carrier storing portion 183, as illustrated. Four rollers or replenishing members 190*a*, 190*b*, 190*c* and 190*d*, each being assigned to a particular color, are positioned below the carrier storing portion 183, and each is controllably driven independently of the others. Assuming that the roller 190*b*, assigned to magenta by way of example, is driven, then the carrier grains received in a cavity 191*b* formed in the roller 190*b* are caused to drop into the joint member 184*b* via a passage 192*b*. Consequently, the carrier grains are conveyed from the joint member 184*b*, which connect the carrier storing portion 183 and the tube 15 of FIG. 6, to the developing unit via the tube 15 together with the toner grains.

It is a common practice with an electrophotographic image forming apparatus to set an adequate toner content range matching with target image density and replenish toner little by little to confine the actual toner content of a developer in the above adequate range, thereby insuring stable image quality.

On the other hand, as for the replenishment of a fresh carrier, deterioration of a carrier is estimated on the basis of the number of images formed or the number of sheets passed in the past, the total operation time of a developing unit or similar information relating to deterioration. The roller stated above is driven over a necessary period of time, i.e., by a necessary amount of rotation in order to deliver an amount of carrier matching with the estimated degree of deterioration, thereby replenishing the carrier to the developing unit little by little. By so replenishing a fresh carrier little by little, it is possible to make up for the deterioration of chargeability of the carrier for thereby maintaining the total chargeability of the entire carrier existing in the developing unit above a limit value. This insures stable image quality over a long period of time without resorting to the conventional periodic replacement of a carrier.

The developer replenishing device of the present invention realizes stable image quality with a simple configuration that can be freely laid out, without increasing the size or the cost of the apparatus body or resorting to special maintenance against aging. Such a developer replenishing device is especially desirable when applied to a color image forming apparatus of the type needing a plurality of developing units and a plurality of toner replenishing devices each being assigned to a particular color. Moreover, the developer replenishing device of the present invention causes carrier grains to join toner grains in order to enhance fluidity for thereby promoting stable toner conveyance using a powder pump. This is particularly advantageous in consideration of the current trend toward toner with a smaller grain size, which is more cohesive and fluid and therefore more difficult to convey.

The illustrative embodiments described above are configured to introduce carrier grains in a toner replenishing path on the basis of gravity for thereby replenishing them to the developing unit 4. By contrast, in other alternative embodiments to be described with reference to FIGS. 8 through 17, carrier grains are entrained by compressed air fed from an air pump and fed to the developing unit 4 at the same time as toner grains.

Figure 8:
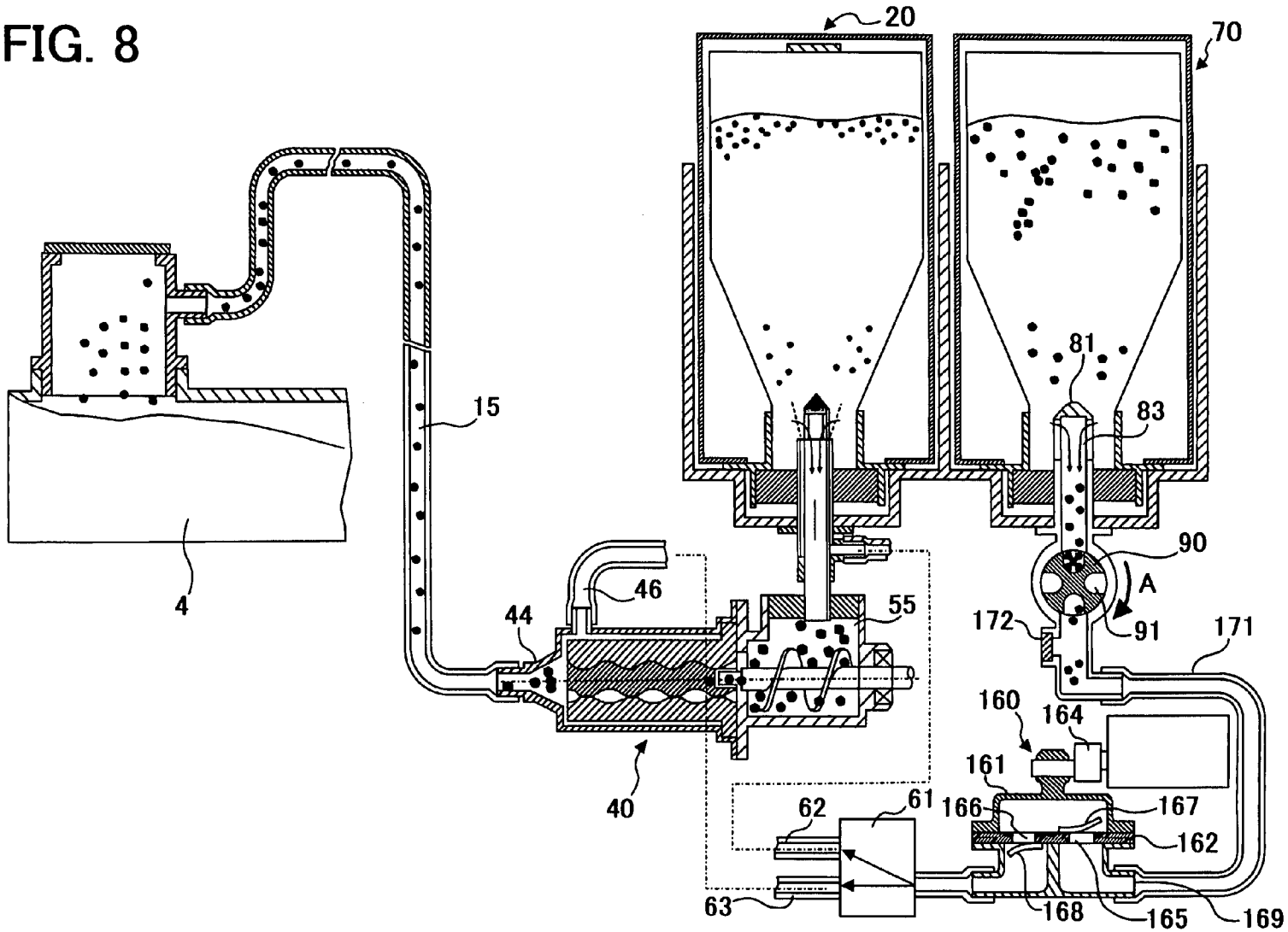
FIG. 8 is a section showing another alternative embodiment of the present invention.

More specifically, FIG. 8 shows another alternative embodiment essentially similar to the embodiment of FIG. 2 except that the toner container 20 and carrier container 70 are replaced in position with each other. Again, the discharge type of powder pump 40 is used to replenish the toner. In FIGS. 2 and 8, identical parts and elements are designated by identical reference numerals, and a detailed description thereof will not be made in order to avoid redundancy. While the illustrative embodiment feeds compressed air to both of the toner container 20 and powder pump 40 like the embodiment of FIG. 2, an air pump 160 included in the former differs in configuration from the air pump 60 included in the latter.

As shown in FIG. 8, the air pump 160 is implemented as a diaphragm type air pump including a cup-like diaphragm 161 formed of, e.g., rubber or soft plastic. The bottom of the diaphragm 161 is held in close contact with a partition 162 in a hermetic condition. The top of the diaphragm 161 is caused to move in the up-and-down direction by an eccentric shaft 164 connected to the output shaft of a motor 163, so that air is selectively sucked into or discharged from the inside of the diaphragm 161. The partition 162 is formed with two ports, i.e., an inlet port 165 and an outlet port 166 provided with an inlet valve 167 and an outlet valve 168, respectively, which are flexible valve members. In this configuration, when the motor 163 is energized, air is sucked into the diaphragm 161 via the inlet port 169 and then discharged via the outlet port 170.

The nozzle 81, configured to penetrate into the carrier container 70, is connected to a suction port 169 included in the air pump 160 by a tube 171. The nozzle 81 is provided with the roller 90 for metering the carrier grains and an air suction hole closed by a filter 172.

The toner stored in the toner container 102 is fluidized by compressed air sent from the air pump 160 and therefore easily drops into the toner storing portion 55, which is included in the powder pump 40, and stored thereon for a moment. When the screw 45 is driven to rotate, it conveys the carrier from the toner storing portion 55 to the powder pump 40. Discharge pressure generated by the powder pump 40 causes the toner to gush out via the outlet 44. Compressed air from the air pump 160 is fed into the toner thus brought to the outlet 44 via the two-way valve 61, tube 63 and air inlet 46, fluidizing the toner. The toner so fluidized is conveyed to the developing unit 4 via the tube 15 by the discharge pressure of the powder pump 40.

On the other hand, the carrier, far higher in fluidity than the toner, drops into the passage 83 formed in the nozzle 81 due to gravity and then enters any one of the cavities 91 of the roller 90. As a result, the carrier is delivered to the downstream side in an amount metered by the cavities 91, i.e., matching with the amount of rotation of the roller 90. Subsequently, the carrier is entrained by air to the air inlet 46, which adjoins the outlet 44 of the air pump 40, via the tube 171, inside of the air pump 160, two-way valve 61 and tube 63 on the basis of suction and delivery generated by the air pump 160. The carrier is then conveyed to the developing unit 4 together with the toner discharged form the powder pump 40.

In the illustrative embodiment, the two-way valve 61 is configured such that it opens the path extending to the toner container 20, but closes the path extending from the powder pump 40, when turned on or blocks the former, but opens the latter, when turned off. More specifically, when the two-way valve 61 is turned off, compressed air or a compressed air and carrier mixture is fed to the powder pump 40. When the two-way valve 61 is turned on, compressed air is fed to the toner container 20.

The printer with the above construction is capable of controlling the amount of carrier replenishment on the basis of the amount of rotation of the roller 90. It is therefore possible to control the amount of carrier replenishment in accordance with the deterioration of the carrier present in the developing unit 4 estimated by use of, e.g., the total operation time of the developing unit 4 or the total amount of toner replenished, i.e., the total toner replenishment time.

Generally, conveyance of the kind using the pressure of, e.g., the powder pump 40 or that of the air pump 160 selectively conveys a light substance and therefore cannot easily convey a substance with great specific gravity or a substance, if light, difficult to contain air, i.e., causes only air to move. Further, because the conveying pressure is proportional to the amount of rotation or spatial movement of the pump, the tendency stated above is particularly conspicuous in the case of conveyance of an extremely small amount, e.g., toner replenishment to the developing unit 4 due to low pressure. While the carrier is feasible for the drop type of conveyance using gravity because of its great specific gravity and high fluidity, as stated previously, the great specific gravity makes it extremely difficult for the carrier to be conveyed by, e.g., the pressure of the powder pump 40. Thus, by mixing a small amount of carrier with toner which is small in specific gravity and easy to contain air, it is possible to convey even the carrier with pressure and simplify the conveying means and conveyance path.

On the other hand, toners available on the market have various degrees of fluidity although they all are small in specific gravity. While toner with high fluidity can easily contain air and can therefore be easily conveyed by pressure, toner with low fluidity is difficult to contain air and cannot be easily conveyed in a stable amount or often stops up the path when conveyed by pressure. Experiments showed that even toner with low fluidity was increased in fluidity and could be stably conveyed by pressure when a small amount of carrier was introduced in the toner.

While the illustrative embodiment delivers the carrier to the powder pump 40, the carrier may be fed to the toner container 20 together with air sent to the toner container 20, if desired. More specifically, an arrangement may be made such that the roller 90 is driven when or just before the air pump 160 and two-way valve 61 are energized to feed compressed air to the toner container 20, feeding the carrier to the toner existing in the toner container 20. In such a case, during toner replenishment, the air pump 160 and two-way valve are so controlled as to feed compressed air to the air inlet 46 simultaneously with the drive of the powder pump 40.

Figure 9:
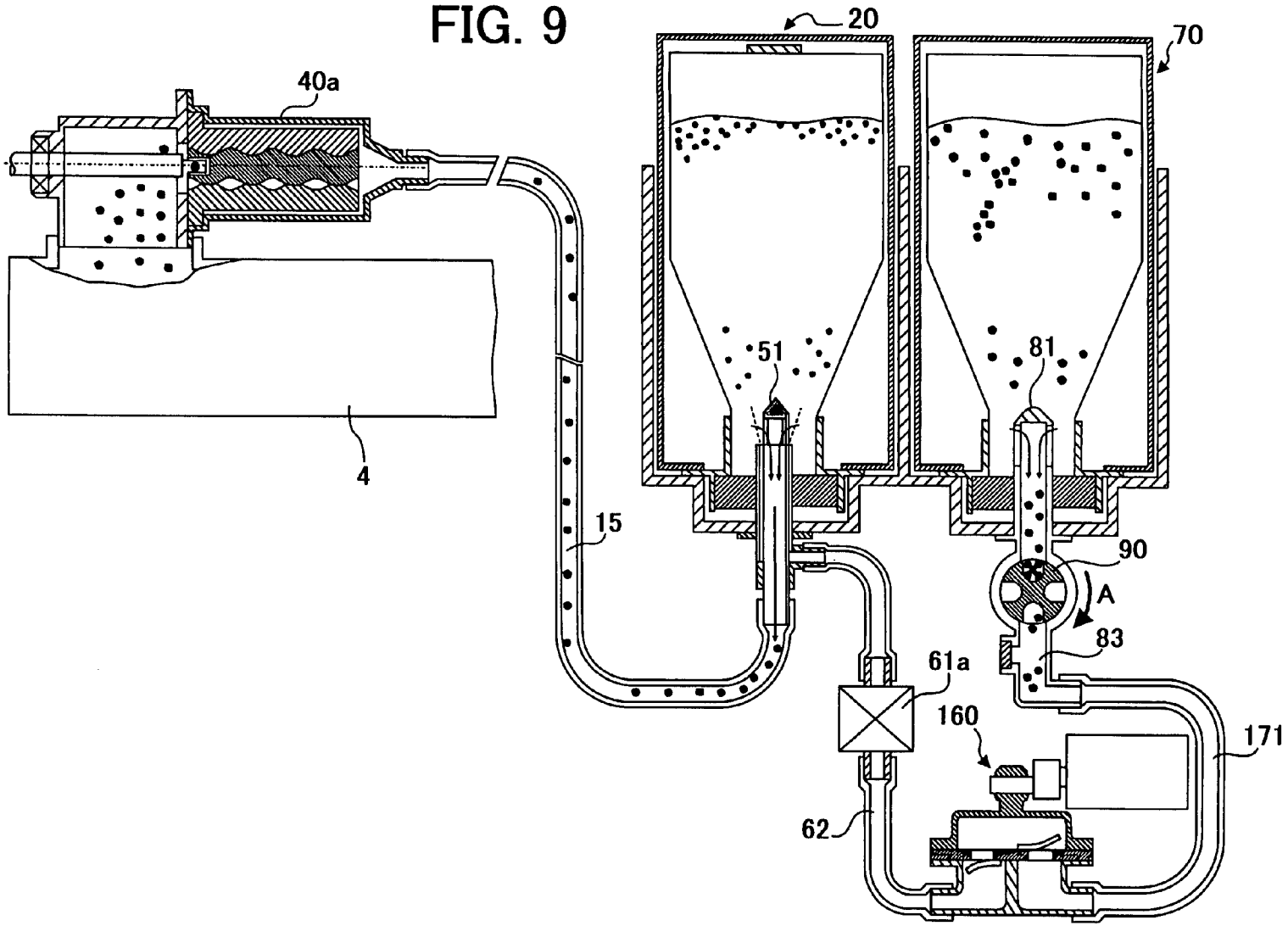
FIG. 9 is a section showing still another alternative embodiment of the present invention.

FIG. 9 shows still another alternative embodiment of the present invention also using compressed air to replenish the carrier. The illustrative embodiment is identical with the embodiment of FIG. 8 except that the suction type powder pump 40 plays the roller of toner and carrier conveying means and that the solenoid-operated valve 61*a* is a one-way valve fluidly communicated only to the nozzle 51 via the tube 62.

In the configuration shown in FIG. 9, the carrier, dropped into the passage 83 after being metered by the roller 90, is conveyed to the toner present in the toner container 20 via the tube 171, inside of the air pump 160, tube 62, valve 61*a* and nozzle 51 by the operation of the air pump 160. The carrier thus mixed with the toner inside the toner container 20 is sucked into the powder pump 40*a* together with the toner via the nozzle 51 and tube 15 and then introduced into the developing unit 4 via the powder pump 40*a*.

The carrier replenishing operation is effected just before or at the same time as the operation of the air pump 160. At this instant, the valve 61*a* is opened simultaneously with the operation of the air pump 160, so that compressed air and carrier are fed into the toner container 20.

Figure 10:
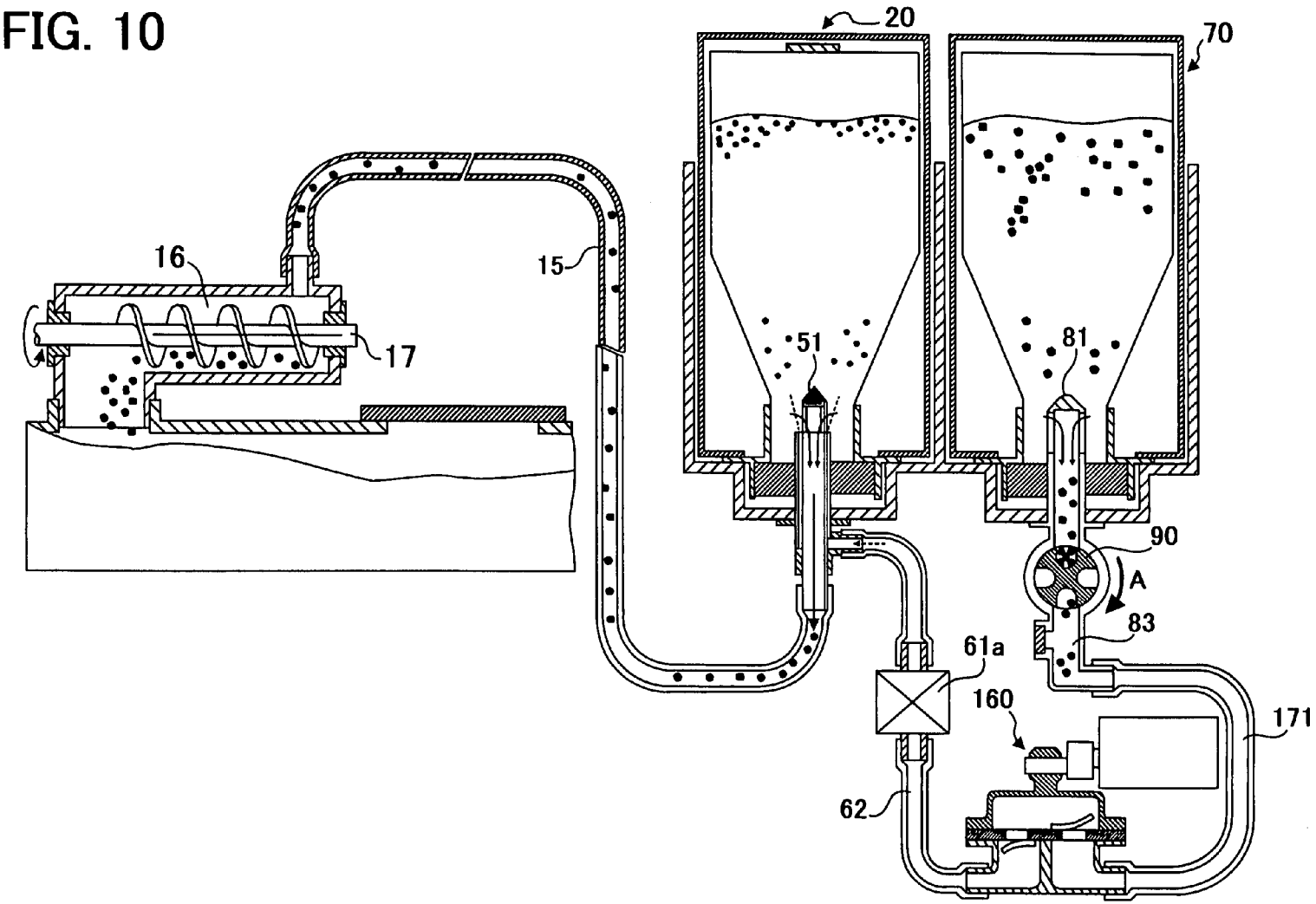
FIG. 10 is a section showing yet another alternative embodiment of the present invention.

FIG. 10 shows yet another alternative embodiment of the present invention also using compressed air to replenish the carrier. The illustrative embodiment differs from the embodiments of FIGS. 8 and 9 in that the conveying means for conveying the toner and carrier is implemented by compressed air delivered from the air pump 160. As for the rest of the construction, the illustrative embodiment is identical with the embodiments of FIGS. 8 and 9.

As shown in FIG. 10, compressed air fed from the air pump 160 into the toner container 20 not only fluidizes the toner in the toner container 20, but also raises pressure inside of the toner container 20. As a result, pressure inside the toner container 20 tends to discharge air and toner from the toner container 20, causing the toner to be conveyed to the hopper 16 via the tube 15 with great force. The toner is then replenished to the developing unit 4 in an adequate amount by the screw 17, which is in rotation.

The carrier dropped into the passage 83 via the replenishing roller 90 is delivered to the toner present in the toner container 20 by compressed air via the tube 171, air pump 160, tube 62 and valve 61*a*. The carrier is then conveyed to the hopper of the developing unit via the tube 15 together with the toner and compressed air.

Figure 11:
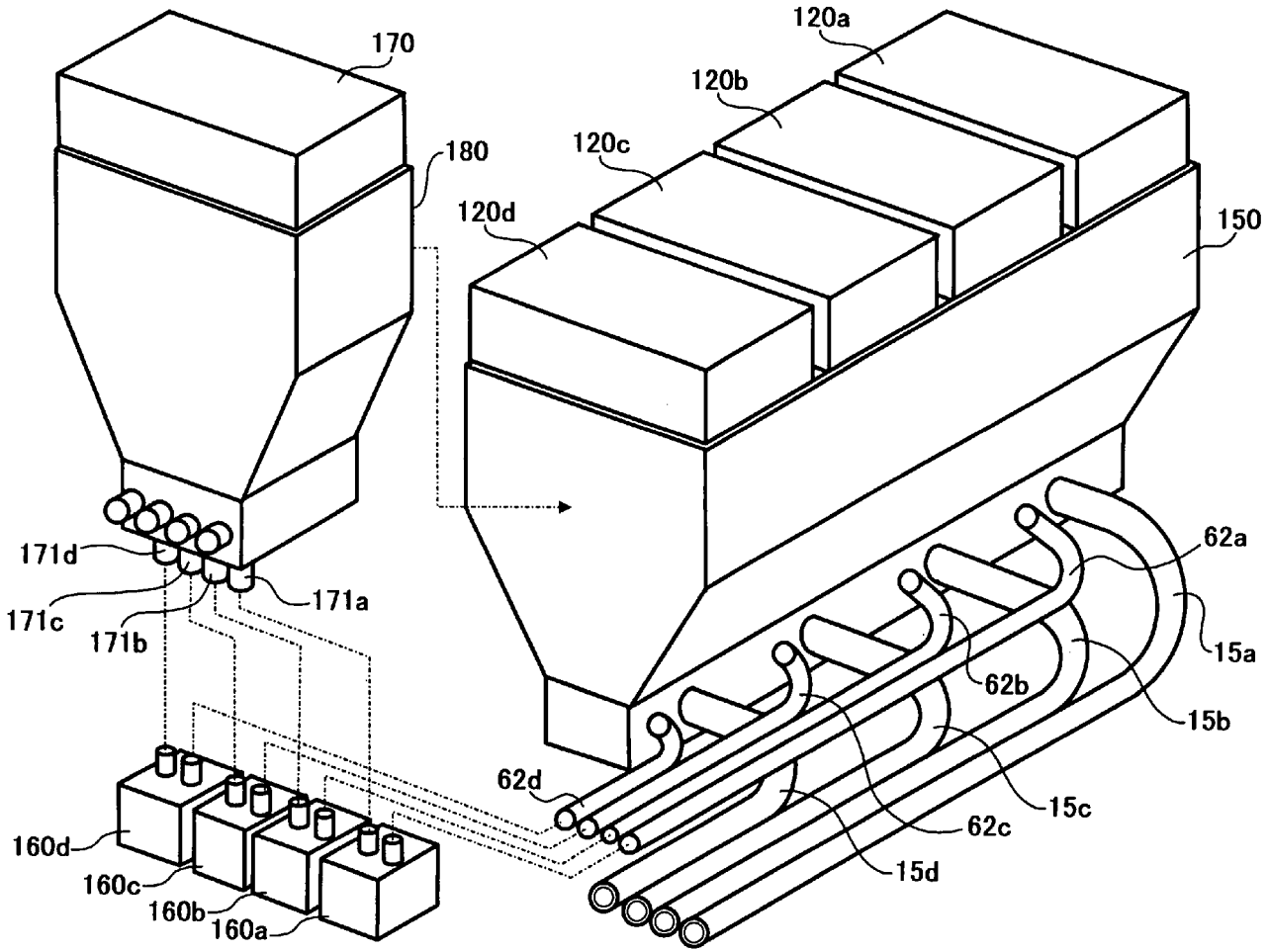
FIG. 11 is a perspective view showing a further alternative embodiment of the present invention and applicable to a color image forming apparatus.

FIG. 1 shows a further alternative embodiment of the present invention also using compressed air to replenish the carrier. The illustrative embodiment is implemented as a color laser printer and similar to the embodiment of FIG. 6 except for the following. In FIG. 11, parts and elements identical with those of FIG. 6 are designated by identical reference numerals, and a detailed description thereof will not be made in order to avoid redundancy.

As shown in FIG. 1, the four toner containers 120*a* through 120*d*, each storing any one of yellow, magenta, cyan and black toners, are removably mounted on the holder 150. While any one of the toner conveying means described with reference to FIGS. 8 through 10 is applicable to the illustrative embodiment, assume that the toner conveying means shown in FIG. 9 is used. The toners stored in the toner containers 120*a* through 120*d* are conveyed via the tubes 15*a* through 15*d*, respectively, by powder pumps, not shown, each being assigned to a particular color.

The carrier container 170 is removably mounted to the holder 180 and arranged in an array together with the toner containers 120*a* through 120*d*. The carrier stored in the carrier container 170 is capable of being metered by the rollers 190*a* through 190*d*, see FIG. 12, and then fed to the toner containers 120*a* through 120*d*, respectively, via four air pumps 160*a* through 160*d* and tubes 62*a* through 62*d*.

Figure 12:
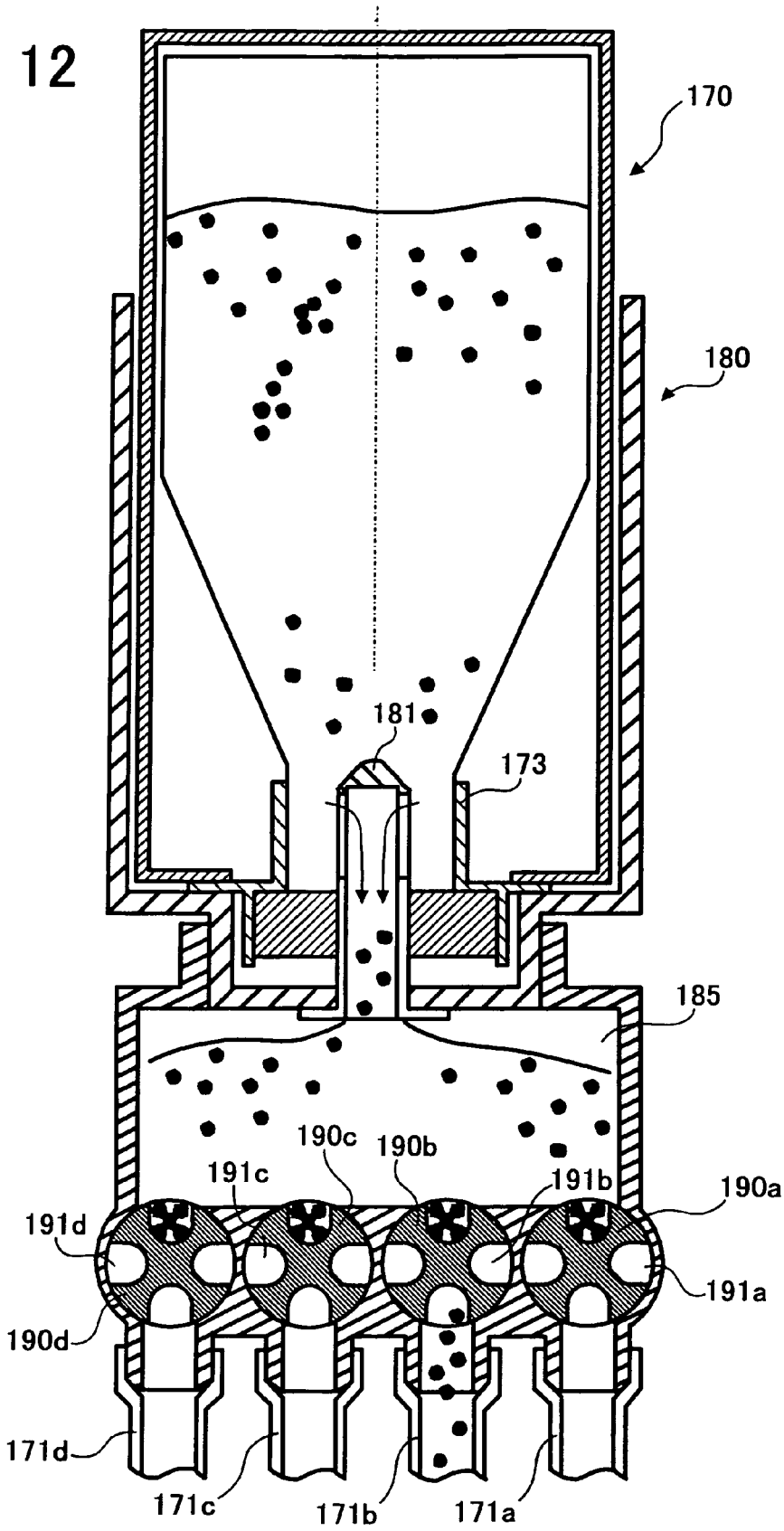
FIG. 12 is a section showing a carrier replenishing device included in the embodiment of FIG. 11.

FIG. 12 shows a developer or carrier replenishing device included in the illustrative embodiment and similar to the developer replenishing device of FIG. 7. In FIG. 12, parts and elements identical with those of FIG. 7 are designated by identical reference numerals, and a detailed description thereof will not be made in order to avoid redundancy. As shown, when the carrier container 170 is mounted to the holder 180, the nozzle 181 penetrates into the mouth member 173 of the carrier container 170. As a result, the carrier, having far higher fluidity than the toner, drops into a carrier storing portion 185 via the nozzle 181 due to gravity and substantially fills up the carrier storing portion 185, as illustrated. The four rollers 190*a*, 190*b*, 190*c* and 190*d*, each being assigned to a particular color, are positioned below the carrier storing portion 185, and each is controllably driven independently of the others.

Assume that the roller 190*b* is assigned to magenta and that the toner container 120*b* stores magenta toner by way of example. Then, when the roller 190*b* is driven to replenish the carrier to be replenished for development in magenta, the carrier in the metering cavity 191*b* of the roller 190*b* drops into a tube 171*b*. At this instant, the air pump 160*b* is energized to deliver the carrier in the tube 171*b* to the toner container 120*b* via the tube 62*b*. Subsequently, when the toner content of the developer present in a magenta developing unit becomes short, the carrier and magenta toner in the toner container 120*b* are replenished to the magenta developing unit together. This is also true with the replenishment of the carrier to the other developing units.

Figure 13:
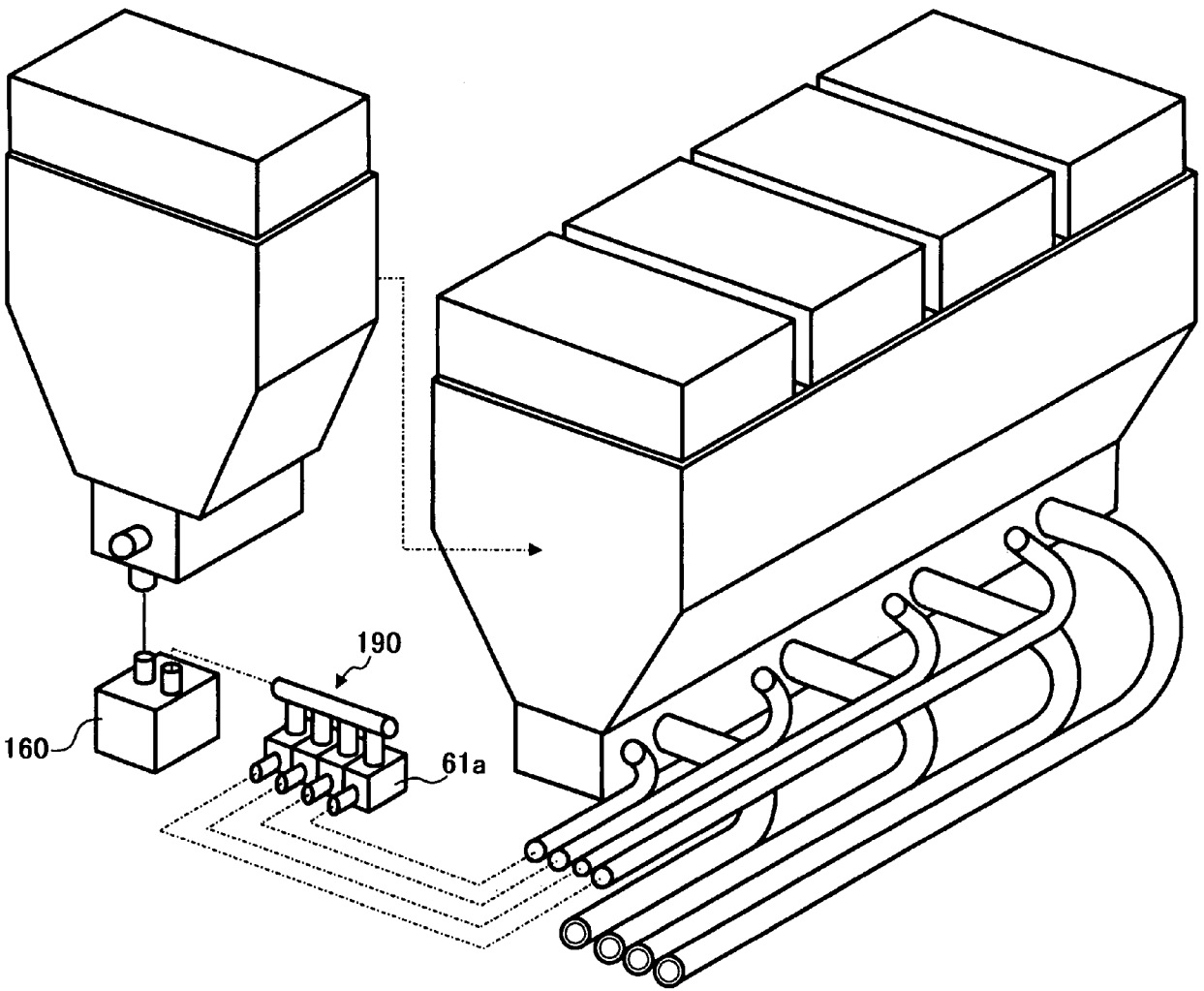
FIG. 13 is a perspective view showing a modification of the embodiment shown in FIG. 11.

FIG. 13 shows a modification of the developer replenishing device described with reference to FIG. 11. As shown, the modification includes carrier distributing means 190 not positioned upstream of the air pump 160 but positioned downstream of the same. With this configuration, the modification is practicable with a single air pump 160 although needing solenoid-operated valves 61*a* identical in number with colors.

Figure 14:
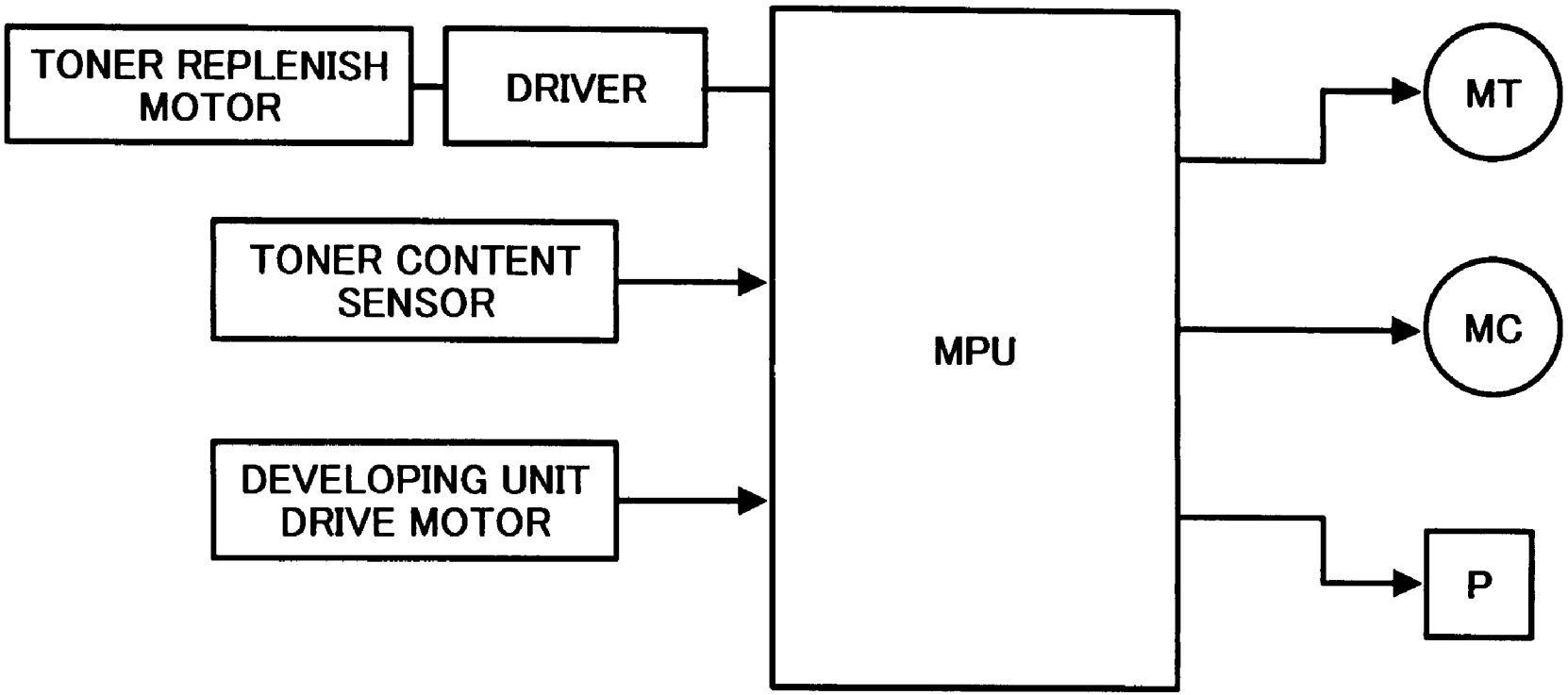
FIG. 14 is a block diagram schematically showing a control system included in the present invention.

Reference will be made to FIG. 14 for describing a control system in accordance with the present invention and relating to toner and carrier replenishment. As shown, the control system includes a control unit having an MPU (MicroProcessing Unit) as a major component. In accordance with the output of a toner content sensor input to the MPU, the MPU sends an operation signal to a toner replenish motor MT via a driver. As a result, toner is replenished from a toner replenishing section included in a printer to a developing unit. Also, the MPU sends an operation signal to the developing unit while incrementing a counter, which is included in the MPU, so as to start counting a developing time, i.e., the duration of operation of the developing unit. Subsequently, when the counter counts up a preselected period of time, the MPU clears the counter and drives a carrier replenish motor MC and an air pump P.

If desired, the counter for counting the operation time of the developing unit may be replaced with a counter for counting successive prints. The MPU, having a timer function, is capable of controllably driving each of the drive motors, air pump and so forth at desired timing. It is desirable to use a nonvolatile RAM (Random Access Memory) so as to prevent the counter from being cleared when a power switch, not shown, is turned off.

Figure 15:
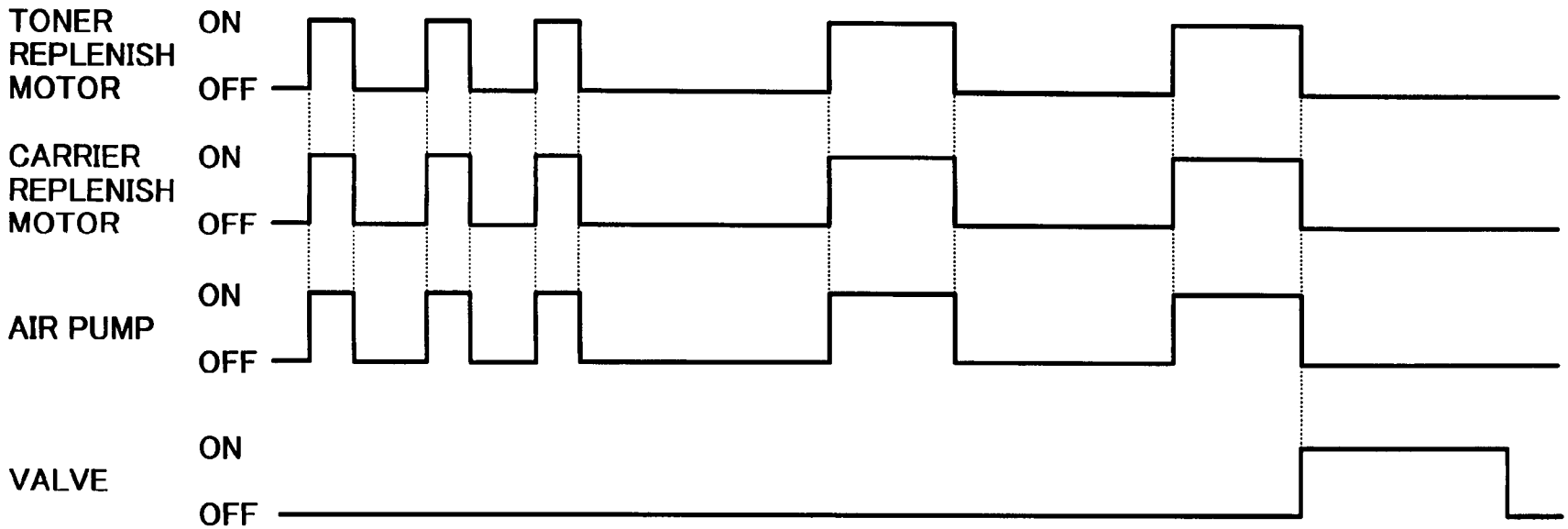
FIG. 15 is a timing chart demonstrating a specific procedure to be executed by a control unit included in the control system.

FIG. 15 is a timing chart demonstrating a specific procedure in which the control unit of FIG. 14 controls the drive motors and air pump. Assume that the specific procedure is applied to the toner and carrier replenishing device shown in FIG. 8 by way of example. As shown, after the counter responsive to the developing time has counted a preselected period of time n, the control unit drives the carrier replenish motor while synchronizing it to the toner replenish motor and, at the same time, drives the air pump 160. At this instant, the two-way valve 61 remains deenergized and therefore delivers compressed air to the powder pump 40. Further, when the total drive time of the toner replenish motor, also counted by the control unit, reaches preselected one, the control unit energizes the air pump 160 together with the two-way valve 61 with the result that compressed air is fed to the toner container 20.

Figure 16:
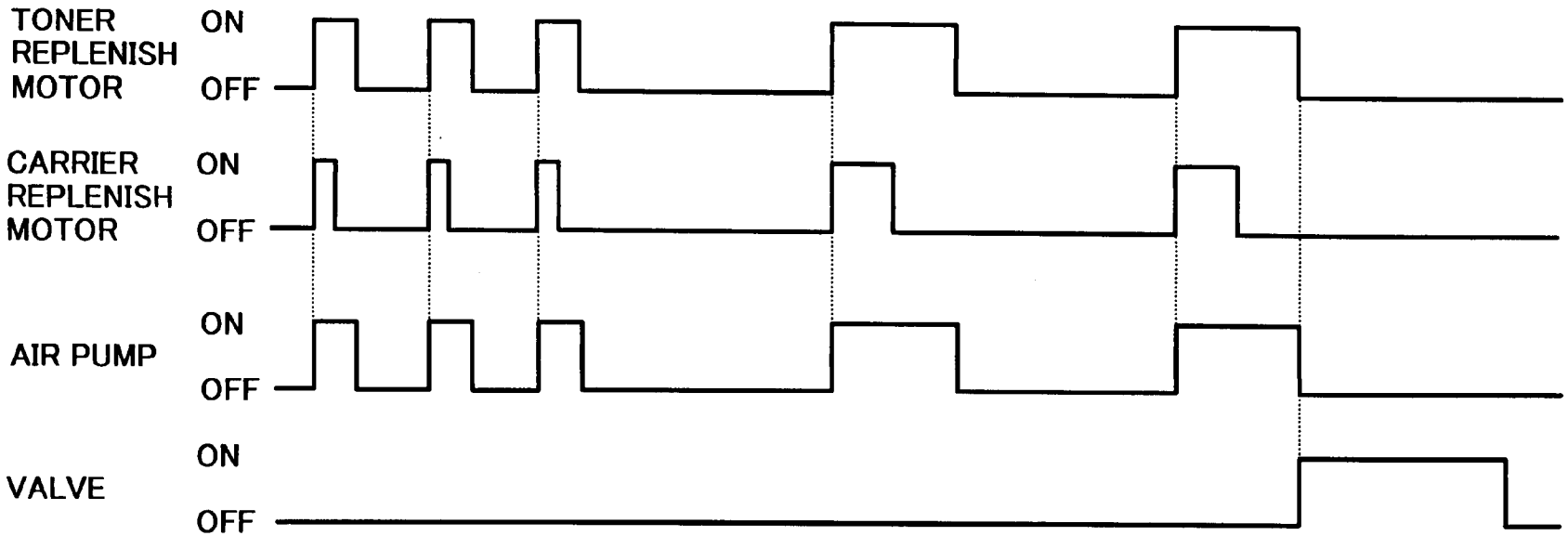
FIG. 16 is a timing chart demonstrating another specific procedure to be executed by the control unit.

FIG. 16 is a timing chart demonstrating another specific procedure in which the control unit controls the drive motors and air pump. This specific procedure is also applied to the toner and carrier replenishing device shown in FIG. 8 by way of example. As shown, while the procedure of FIG. 15 fully synchronizes the drive of the carrier replenish motor to the drive of the toner replenish motor, the procedure of FIG. 16 varies, in accordance with a developing time or the number of prints between repeated toner replenishment, the next carrier replenish motor drive time for thereby controlling the amount of carrier replenishment. More specifically, assume that the developing time between the stop of the toner replenish motor and the start of the same after the stop is Tb. Then, the control unit shortens the next carrier replenish motor drive time if the developing time Tb is short or extends the former if the latter is long. In this manner, the control unit controls carrier replenishment in accordance with carrier deterioration, which is aggravated in accordance with the duration of development.

Figure 17:
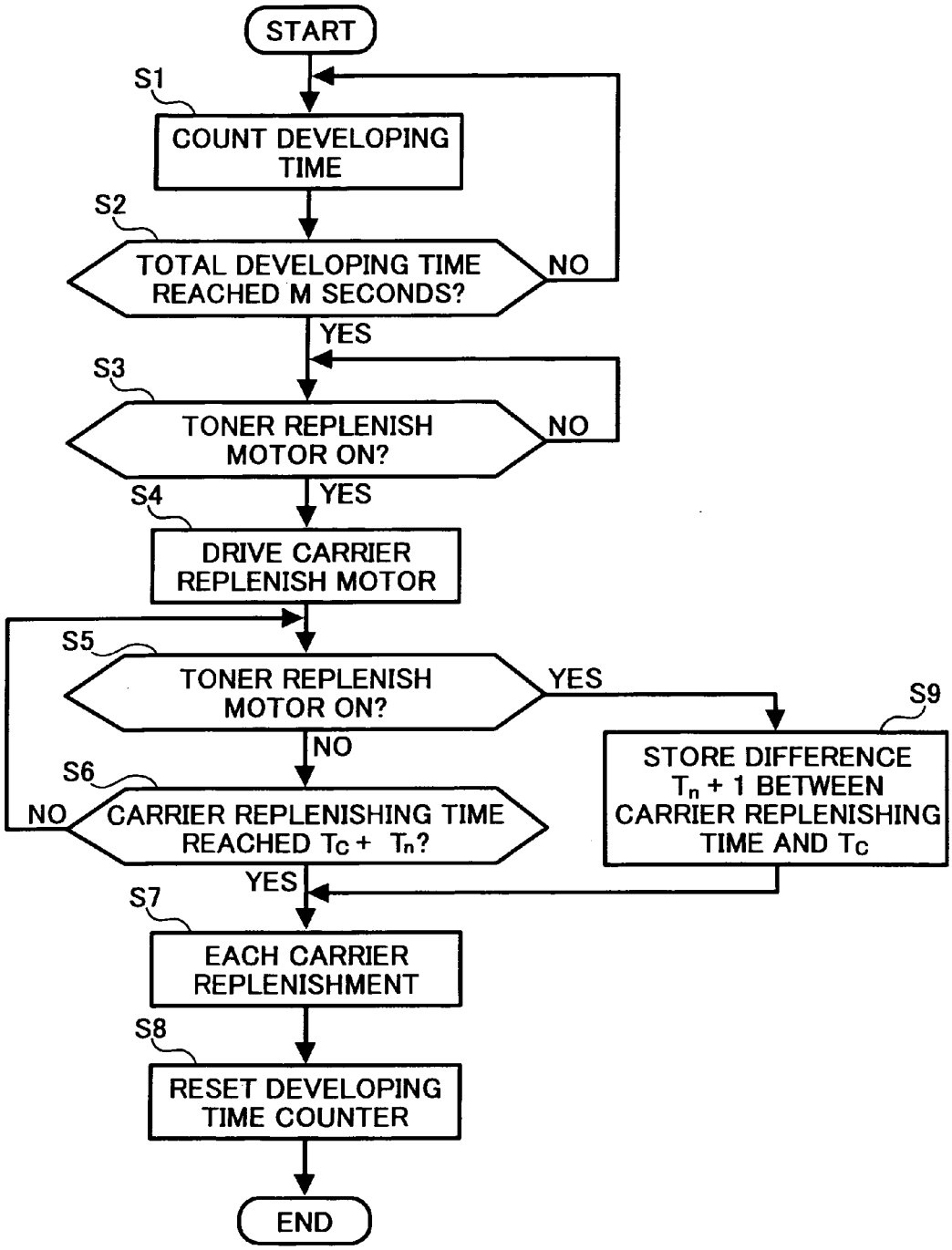
FIG. 17 is a flowchart showing a specific control procedure available with the present invention.

FIG. 17 shows a specific procedure in which the control unit, FIG. 14, controls the replenishment of a carrier of a given color. The procedure to be described applies to carriers of the other colors as well and is executed for each print in response to an operation signal sent to the drive motor of the developing unit 4. As shown, the control unit first counts a developing time with the counter in order to determine the degree of deterioration and replenish the carrier (step S1). The control unit then determines whether or not the total developing time after resetting has reached M seconds (step S2). If the answer of the step S2 is negative (N), the procedure returns to the step S1.

If the answer of the step S2 is positive (Y), meaning that the total developing time has reached M seconds, the control unit determines whether or not the toner replenish motor is in operation, i.e., whether or not toner replenishment is under way (step S3). If the answer of the step S3 is N, the control unit simply waits without replenishing the carrier. If the answer of the step S3 is Y, the control unit starts driving the carrier replenish motor (step S4). At this instant, the control unit starts driving the air pump as well.

Subsequently, the control unit determines whether or not the toner replenish motor should be turned off (step S5). Because carrier replenishment under way must be stopped when toner replenishment is stopped, the step S5 is executed until the carrier replenishing time reaches the sum of a preselected period of time Tc and a difference Tn of the last carrier replenishment. If the answer of the step S5 is N, the control unit determines whether or not the carrier replenishing time has reached the above sum Tc+Tn (step S6). If the answer of the step S6 is N, the procedure returns to the step S5. If the answer of the step S6 is Y, the control unit ends carrier replenishment (step S7) and resets the counter assigned to the developing time (step S8).

If the answer of the step S5 is N, meaning that the toner replenish motor should be turned off, the control unit stops driving the toner replenish motor and stores a period of time Tn+1, i.e., a difference between the preselected period of time Tc and the carrier replenishing time (step S9). At this instant, if the carrier replenishing time has reached the preselected period of time Tc, the control unit stores 0 (zero). The step S9 is also followed by the step S7.

In summary, in accordance with the present invention, it is possible to achieve stable image quality with a simple configuration that can be freely laid out, without increasing the size or the cost of the body of an image forming apparatus or resorting to special maintenance against aging. This advantage is especially prominent when it comes to a color image forming apparatus of the type using a multicolor developing unit and a multicolor toner replenishing device. In addition, by causing a carrier to join toner, it is possible to enhance fluidity for thereby promoting stable toner conveyance using a powder pump. This advantage is particularly prominent in consideration of the current trend toward toner with a smaller grain size, which is more cohesive and fluid and therefore more difficult to convey.

Further, in accordance with the present invention, the carrier is replenished when the toner is moving in a toner replenishing path, and can therefore be easily conveyed by a toner conveying force despite its great specific gravity. In addition, the carrier introduced into the toner enhances the fluidity of the toner itself for thereby promoting stable conveyance and efficient dispersion of the carrier in the toner. This insures easy, efficient charging in the developing unit. Moreover, toner conveyance using the powder pump allows a conveying path, a toner replenishing device and a carrier replenishing device to be freely laid out and implements size reduction of the apparatus body. Mixing the carrier in the toner, which is apt to cohere when subjected to pressure and heat, is successful to enhance the fluidity of the tone and stabilizes toner and carrier conveyance using a discharge type powder pump. This is also true when toner conveyance is implemented by compressed air.

Various modifications will become possible for those skilled in the art after receiving the teachings of the present disclosure without departing from the scope thereof.

Obviously, numerous modifications and variations of the present invention are possible in light of the above teachings. It is therefore to be understood that within the scope of the appended claims, the invention may be practiced otherwise than as specifically described herein.

The invention claimed is:

1. An image forming apparatus comprising:

a carrier storing portion storing a carrier;

a conveying path configured to convey the carrier to a developing unit from the carrier storing portion;

air sending means for sending air under pressure to said conveying path as a conveying force for conveying the carrier; and replenishing means for replenishing the carrier stored in said carrier storing portion to said conveying path;

said replenishing means being provided on a carrier replenishing passage extending from said carrier storing portion to a portion where said carrier replenishing passage joins said conveying path, said replenishing means being configured to obstruct entry of air to said carrier storing portion and replenish the carrier by a preselected amount, wherein said carrier comprises a powdered carrier and said replenishing member comprises a rotatable roller housed within said carrier replenishing passage and provided outside said carrier storing portion, said rotatable roller having a diameter large enough to block said carrier conveying path and being formed with a metering cavity in a circumferential surface thereof.

2. The apparatus as claimed in claim 1, wherein toner is also conveyed by the air.

3. The apparatus as claimed in claim 1, wherein said rotatable roller has a plurality of metering cavities formed therein for metering conveyance of the powered carrier to said carrier conveying path.

4. The apparatus as claimed in claim 1, which comprises a toner container positioned upstream of said carrier storing portion for storing a toner and wherein said conveying path is configured to combine the carrier from the carrier storing portion with the toner from the toner container and to convey the carrier and toner as combined to a developing unit.

5. An image forming apparatus comprising:

a carrier storing portion storing a carrier;

a conveying path configured to convey the carrier to a developing unit from the carrier storing portion;

an air sending device for sending air under pressure to said conveying path as a conveying force for conveying the carrier; and a replenishing device for replenishing the carrier stored in said carrier storing portion to said conveying path;

said replenishing device being provided on a carrier replenishing passage extending from said carrier storing portion to a portion where said carrier replenishing passage joins said conveying path, said replenishing device being configured to obstruct entry of air to said carrier storing portion and replenish the carrier by a preselected amount, wherein said carrier comprises a powdered carrier and said replenishing member comprises a rotatable roller housed within said carrier replenishing passage and provided outside said carrier storing portion, said rotatable roller having a diameter large enough to block said carrier conveying path and being formed with a metering cavity in a circumferential surface thereof.

6. The apparatus as claimed in claim 5, wherein toner is also conveyed by the air.

7. The apparatus as claimed in claim 5, wherein said rotatable roller has a plurality of metering cavities formed therein for metering conveyance of the powered carrier to said carrier conveying path.

8. The apparatus as claimed in claim 5, which comprises a toner container positioned upstream of said carrier storing portion for storing a toner and wherein said conveying path is configured to combine the carrier from the carrier storing portion with the toner from the toner container and to convey the carrier and toner as combined to a developing unit.

* * * * *